US008904589B2

(12) United States Patent
Santarsiero et al.

(10) Patent No.: US 8,904,589 B2
(45) **Date of Patent: *Dec. 9, 2014**

(54) CLEANUP SYSTEM

(76) Inventors: Paul Santarsiero, Avon, CT (US); Roger Comora, Jacksonville Beach, FL (US)

( * ) Notice: Subject to any disclaimer, the term of this patent is extended or adjusted under 35 U.S.C. 154(b) by 510 days.

This patent is subject to a terminal disclaimer.

(21) Appl. No.: 13/134,588

(22) Filed: Jun. 10, 2011

(65) Prior Publication Data

US 2011/0302735 A1 Dec. 15, 2011

Related U.S. Application Data

(60) Provisional application No. 61/397,510, filed on Jun. 11, 2010.

(51) Int. Cl.

| | |
|---|---|
| ***A47L 13/52*** | (2006.01) |
| ***A46B 15/00*** | (2006.01) |
| ***A47L 13/12*** | (2006.01) |
| ***A47L 13/11*** | (2006.01) |

(52) U.S. Cl.

CPC ..... *A47L 13/52* (2013.01); *A46B 2200/3033* (2013.01); *A46B 15/0055* (2013.01); *A47L 13/12* (2013.01); *A47L 13/11* (2013.01)

USPC ..... 15/105; 15/257.1; 15/257.2; 15/257.7; 15/257.9

(58) Field of Classification Search

None

See application file for complete search history.

(56) References Cited

U.S. PATENT DOCUMENTS

| | | | | |
|---|---|---|---|---|
| 346,761 | A | | 8/1886 | Marsh et al. |
| 389,366 | A | | 9/1888 | Cunningham |
| 492,373 | A | | 2/1893 | Minor |
| 715,756 | A | | 12/1902 | Clover |
| 720,761 | A | | 2/1903 | Wade |
| 772,093 | A | | 10/1904 | Forden |
| 834,770 | A | | 10/1906 | Steele |
| 1,255,902 | A | | 2/1918 | Marriott |
| 2,176,135 | A | | 10/1939 | Horst |
| 2,879,530 | A | | 3/1959 | Ego |
| 2,999,259 | A | | 9/1961 | Sheldon |
| 3,002,209 | A | | 10/1961 | McKinstry |
| 3,056,993 | A | | 10/1962 | Lewis |
| 3,220,042 | A | | 11/1965 | Harrington, Sr. |
| 3,382,523 | A | | 5/1968 | Leroy |
| 4,148,513 | A | | 4/1979 | Gagne |
| 4,360,947 | A | | 11/1982 | Decosa |
| 4,741,566 | A | | 5/1988 | Byung-Do |
| 5,012,542 | A | | 5/1991 | Lynn |
| 5,437,078 | A | | 8/1995 | Courcelles |
| D383,002 | S | * | 9/1997 | Rigney ..... D4/116 |
| 5,974,624 | A | | 11/1999 | Eisen |
| 6,039,368 | A | * | 3/2000 | Kowalczyk ..... 294/1.3 |
| 6,052,860 | A | * | 4/2000 | Coxsey ..... 15/257.2 |
| D441,933 | S | | 5/2001 | Savage |
| D462,529 | S | | 9/2002 | Best |

(Continued)

FOREIGN PATENT DOCUMENTS

GB 1021750 * 3/1966 ..... A47L 13/52

*Primary Examiner* — Monica Carter
*Assistant Examiner* — Stephanie Berry
(74) *Attorney, Agent, or Firm* — Ira S. Dorman

(57) ABSTRACT

The cleanup system employs an associated clearing component, such as a tool comprised of squeegee and/or brush elements, to close the entrance to a containment or receptacle unit to thereby prevent leakage or escape of liquid, semi-liquid, and/or dry matter during transport.

11 Claims, 24 Drawing Sheets

(56) References Cited

U.S. PATENT DOCUMENTS

| | | | | |
|---|---|---|---|---|
| 6,477,733 | B1 | 11/2002 | Kuhns | |
| 7,404,229 | B2 | 7/2008 | Monahan | |
| 2001/0041024 | A1* | 11/2001 | Zawlocki | 383/127 |
| 2003/0167588 | A1 | 9/2003 | Perelli | |
| 2007/0089259 | A1 | 4/2007 | Jones | |
| 2008/0092321 | A1 | 4/2008 | Lin | |
| 2009/0223007 | A1 | 9/2009 | Li | |

* cited by examiner

10'
33
40

33
10'
40

33
40'
45
41
10'
49

33
40
10
10'
44'
17'
15
17'
43
10

43
47
41
43
47
45

14
10
44'
26
28
46
49
B

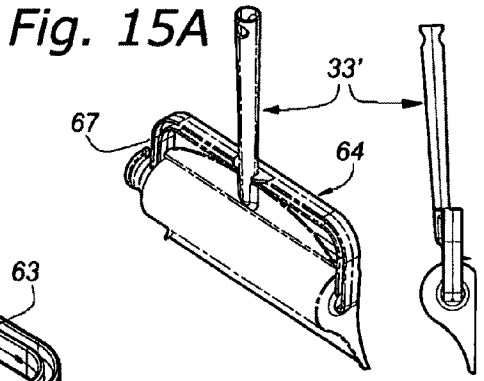
Fig. 15A
Fig. 15B
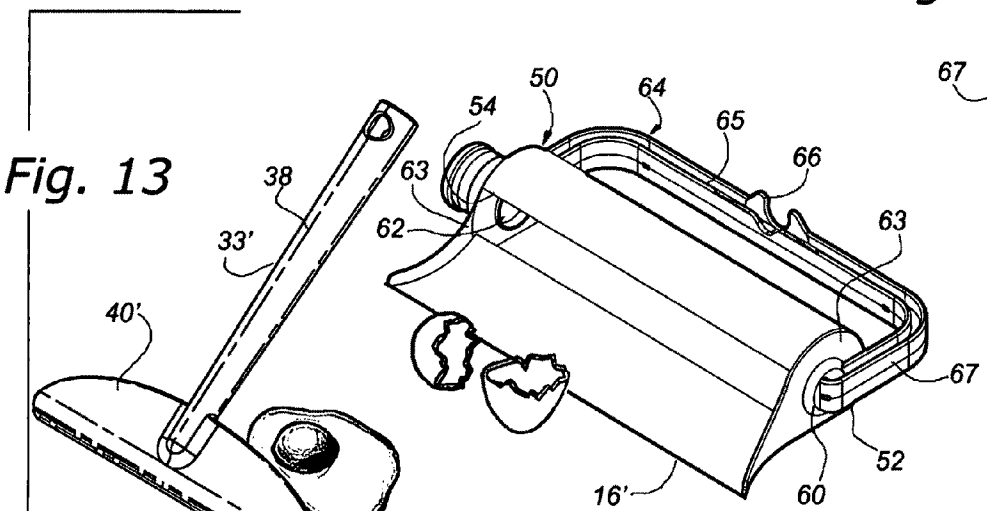
Fig. 13
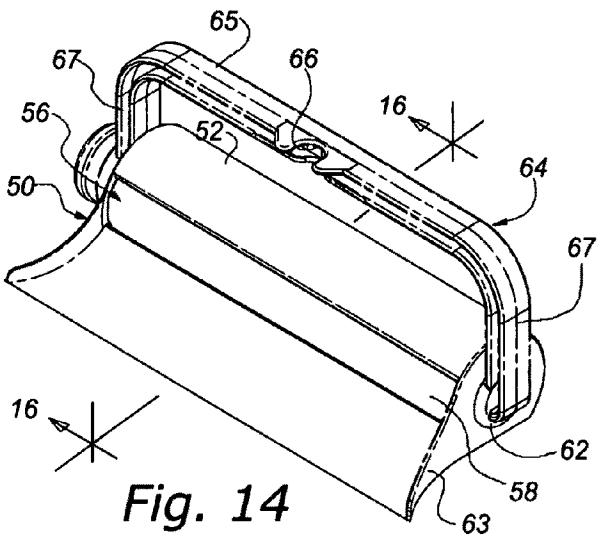
Fig. 14

64
59
33'
34

58
54
20
20
64

54
64
50
46
B

64'
90
96
50'

90
98
97
64

50'
64'

90
61'
64'
97
50'

98
64'
99
50'
96
92
97
90
99
94

CLEANUP SYSTEM

CROSS-REFERENCE TO RELATED APPLICATION

This application claims the benefit of U.S. Provisional Patent Application No. 61/397,510, entitled CLEANUP SYSTEM and filed, in the names of the inventors hereof, on Jun. 11, 2010.

BACKGROUND OF THE INVENTION

Numerous devices and systems are known in the art, and are commercially available, for use in effecting the physical removal of solid and liquid substances from surfaces. Such a system might, in rudimentary form, simply comprise a dustpan and a broom, or a squeegee and a cooperating receptacle unit. The following United States patent documents are representative of prior art that may be germane to the present invention:

| |
|---|
| U.S. Pat. No. 346,761 |
| U.S. Pat. No. 389,366 |
| U.S. Pat. No. 492,373 |
| U.S. Pat. No. 715,756 |
| U.S. Pat. No. 720,761 |
| U.S. Pat. No. 772,093 |
| U.S. Pat. No. 834,770 |
| U.S. Pat. No. 1,255,902 |
| U.S. Pat. No. 2,176,135 |
| U.S. Pat. No. 2,879,530 |
| U.S. Pat. No. 2,999,259 |
| U.S. Pat. No. 3,002,209 |
| U.S. Pat. No. 3,056,993 |
| U.S. Pat. No. 3,220,042 |
| U.S. Pat. No. 3,382,523 |
| U.S. Pat. No. 4,148,513 |
| U.S. Pat. No. 4,360,947 |
| U.S. Pat. No. 4,741,566 |
| U.S. Pat. No. 5,012,542 |
| U.S. Pat. No. 5,437,078 |
| U.S. Pat. No. 5,974,624 |
| U.S. Pat. No. 6,477,733 |
| U.S. Pat. No. 7,404,229 |
| U.S. Pat. No. D441,933 |
| U.S. Pat. No. D462,529 |
| U.S. Pat. Pub. No. 2003/0167588 |
| U.S. Pat. Pub. No. 2007/0089259 |
| U.S. Pat. Pub. No. 2008/0092321 |
| U.S. Pat. Pub. No. 2009/0223007 |

Despite the level of activity indicated by the foregoing, a need exists for a system by which dry liquid or semi-liquid (wet) matter can readily be moved into a receptacle and maintained therein against escape, undue leakage, or spillage, such as during transport to a disposal location.

SUMMARY OF THE INVENTION

It is a broad object of the present invention to provide a cleanup system with which liquid, semi-liquid, and/or dry matter can readily be moved from a surface into a receptacle and maintained therein without escape, undue leakage, or spillage.

More specific objects of the invention are to provide such a cleanup system in which a clearing component (e.g., a squeegee tool) is engageable with a cooperating receptacle component for closing the access opening through which the removed matter passes into a chamber of the receptacle, so as to prevent such escape, leakage or spillage and, in some instances, for at least substantially sealing the opening; or, alternatively, in which the receptacle itself has self-contained means for closing, the access opening.

Additional objects of the invention are to provide a system having the foregoing features and advantages, which system is of relatively incomplex and inexpensive construction, is easy and convenient to use and store, is highly effective for its intended purposes, and may as a practical matter, be at least substantially disposable.

It has now been found that certain of the foregoing and related objects of the invention are readily attained by the provision of a cleanup system comprised of a containment unit and a separate clearing component; the containment unit having an interior chamber for containing matter, and having structure defining an entrance to the interior chamber; the clearing component comprising closure structure having at least one marginal portion with a surface-clearing element thereon; at least one of the containment unit and the clearing component having means thereon for securing the containment unit and the clearing component in an interengaged relationship in which the closure structure of the clearing component overlies the entrance to the interior chamber of the containment unit; and the closure structure being dimensioned and configured to substantially close the entrance, in the overlying position, against the escape of matter therethrough from the interior chamber.

In certain embodiments the containment unit comprises a rigid body defining the interior chamber, and the clearing component is a tool having a head member providing the closure structure; the entrance-defining structure of the containment unit may include a ramp portion leading to the interior chamber. Preferably, the containment unit body will have a rearwardly extending handle thereon and the tool will have a handle extending from its head member, the handles on the body and tool being constructed for interengagement to provide the means for securing the containment unit and the clearing component in interengaged relationship.

The surface-clearing element provided on the head member of a tool will normally comprise a squeegee element or a brush element, or both. The head member will desirably be dual-sided with opposite, substantially parallel marginal portions extending thereacross, each of which marginal portions has a surface-clearing element thereon, one being a squeegee element and the other being a brush element. The entrance-defining structure of the containment unit will advantageously include, along a bottom edge, an internal wall portion so constructed that, in the interengaged relationship, the surface-clearing element of the head member of the tool will be disposed against the internal wall portion to cooperate in effecting substantial closure of the entrance to the interior chamber, particularly effective closure being afforded when the surface-clearing element disposed against such an internal wall portion is a squeegee element. Effective closure will also be promoted by constructing mating portions of the head member of the tool and the entrance-defining structure of the containment unit so as to conform closely to one another, and suitable gasket elements may be incorporated to provide a liquid-tight, substantially sealed assembly.

The body of the containment unit may include structure defining a clean-out and/or material discharge port, having an associated removable cap for normally closing the port. A disposable, bag-like insert may desirably be contained within the interior chamber of the body, the insert having a normally open mouth disposed to cooperate with the entrance-defining structure of the containment unit for the receipt of matter displaced thereinto. In such embodiments the containment unit will preferably include a top wall portion, or lid, that is displaceable to facilitate insertion and removal of the bag-like insert.

In other embodiments of the cleanup system of the invention the containment unit comprises a frame and bag-like structure having a mouth leading to an interior chamber, the bag-like structure being assembled with the frame with its mouth cooperating with the frame to provide the entrance-defining structure of the containment unit; a handle will normally be attached to the frame. Here again, the clearing component will desirably be a tool comprised of head member, that provides the closure structure, and a handle extending therefrom, with the handles on the containment unit body and the tool being constructed for interengagement to provide the means for securing the containment unit and the tool to one another. The bag-like structure will desirably be disengageably assembled with the frame so as to permit ready disposal, and reuse of the frame.

In still other embodiments of the invention, the containment unit comprises front structure, typically in the form of a panel that is at least semirigid and that has at least one aperture therethrough, and bag-like structure having a mouth that leads to an interior chamber, the bag-like structure being assembled with the front panel so that its mouth cooperates with the aperture of the panel to provide the entrance-defining structure of the containment unit. Here too, the clearing component will usually be a tool having a head member providing the closure structure, the head member of the tool and the front panel of the containment unit desirably being constructed to enable snap-fit interengagement of the head member within the front panel aperture. The front panel will normally be generally planar, but may advantageously be formed with bottom and opposite lateral marginal portions that are inclined, relative to the plane, to provide an inwardly tapered configuration, and a second aperture, through an upper portion of the front panel, may cooperate with adjacent structure to provide a handle for carrying the containment unit. The clearing tool will normally include a handle attached to the head member, and disengageable attachment of the handle (by means of interfitting parts or by use of, for example, a spring-loaded bolt) will enable the economical discard of all other components of the system after a single use.

BRIEF DESCRIPTION OF THE ILLUSTRATED EMBODIMENTS

Figure 3C:
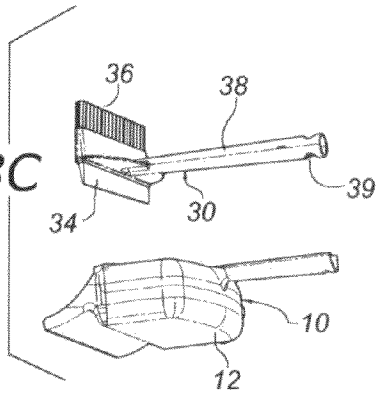
Figure 3D:
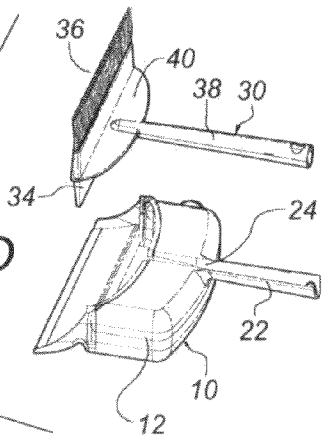
Figure 1:
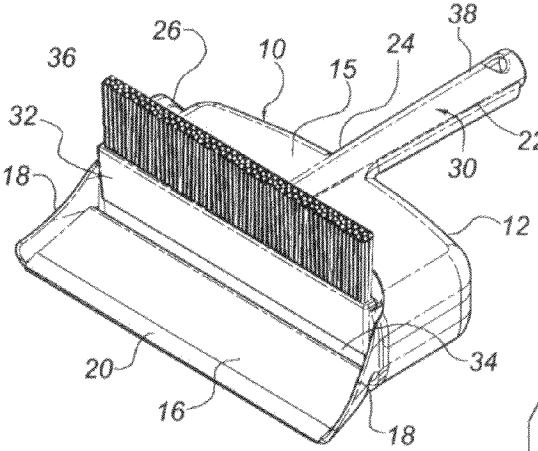
FIG. 1 is a perspective view of a first embodiment of the system of the invention, wherein a squeegee tool is assembled with a dustpan-like receptacle or containment unit.
Figure 3A:
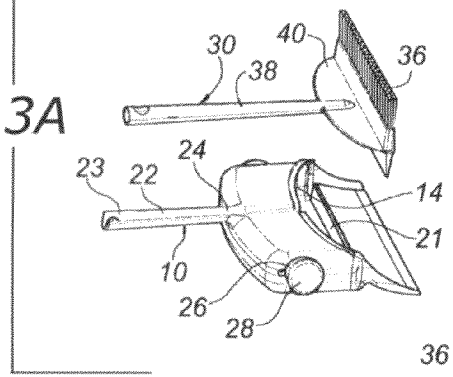
Figure 3B:
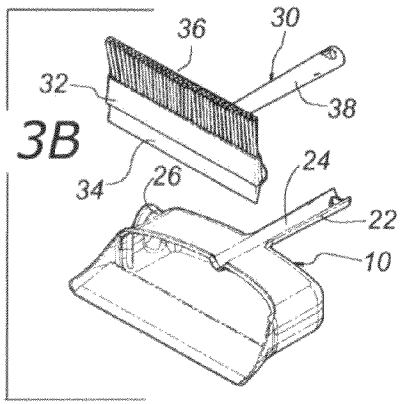
Figure 2A:
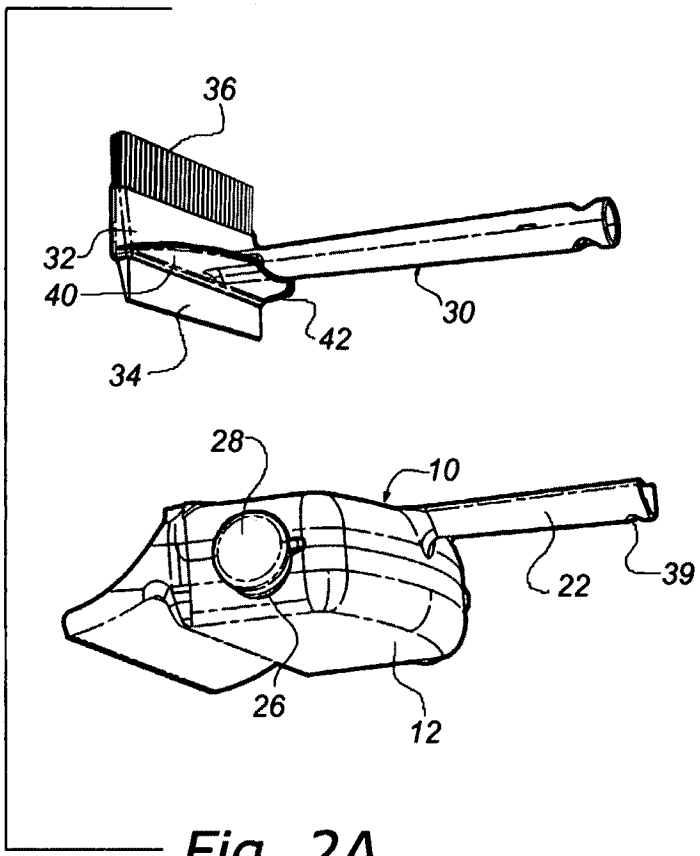
FIGS. 2A and 2B are exploded perspective views of the system of FIG. 1.
Figure 2B:
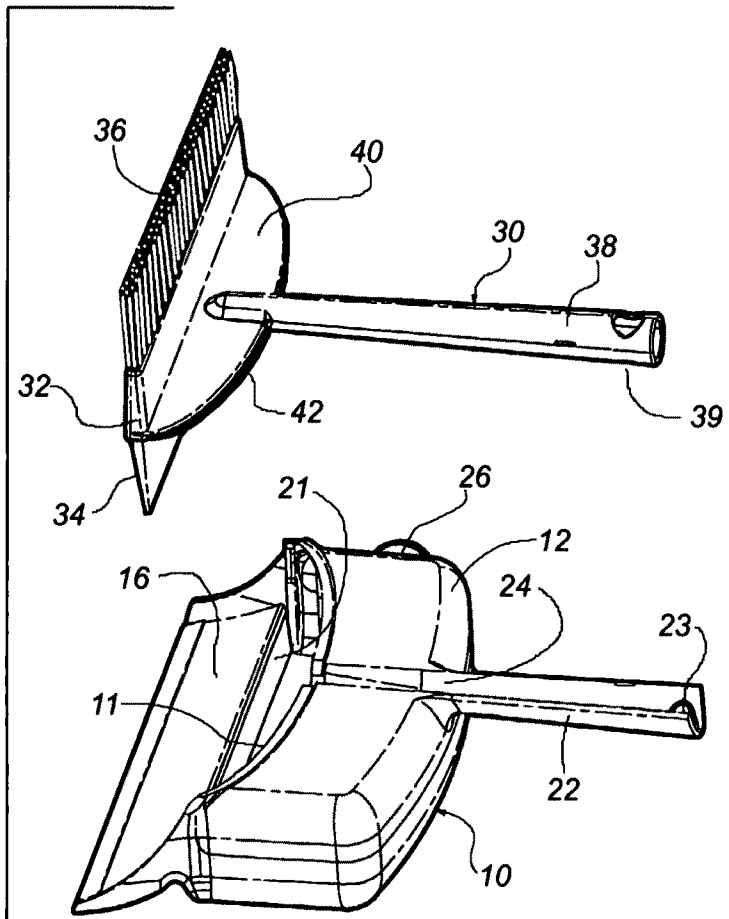
Figure 4:
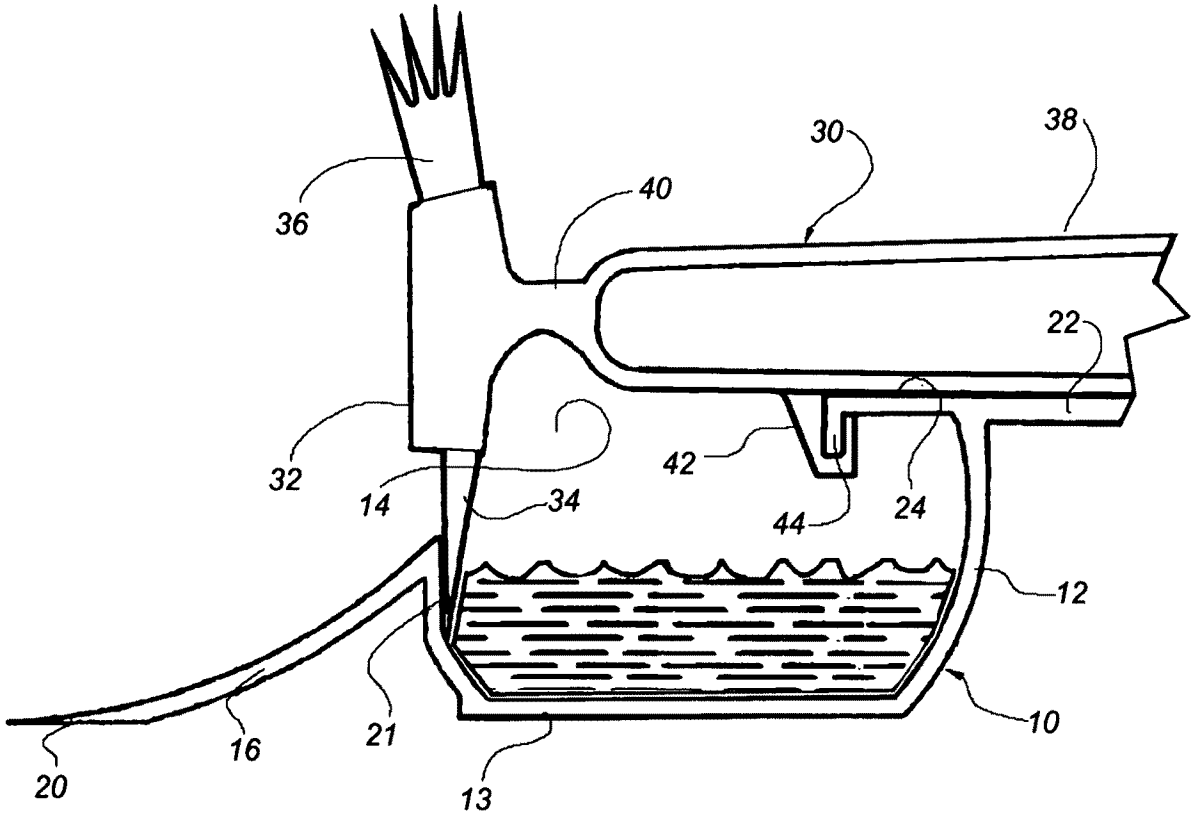
Figure 5:
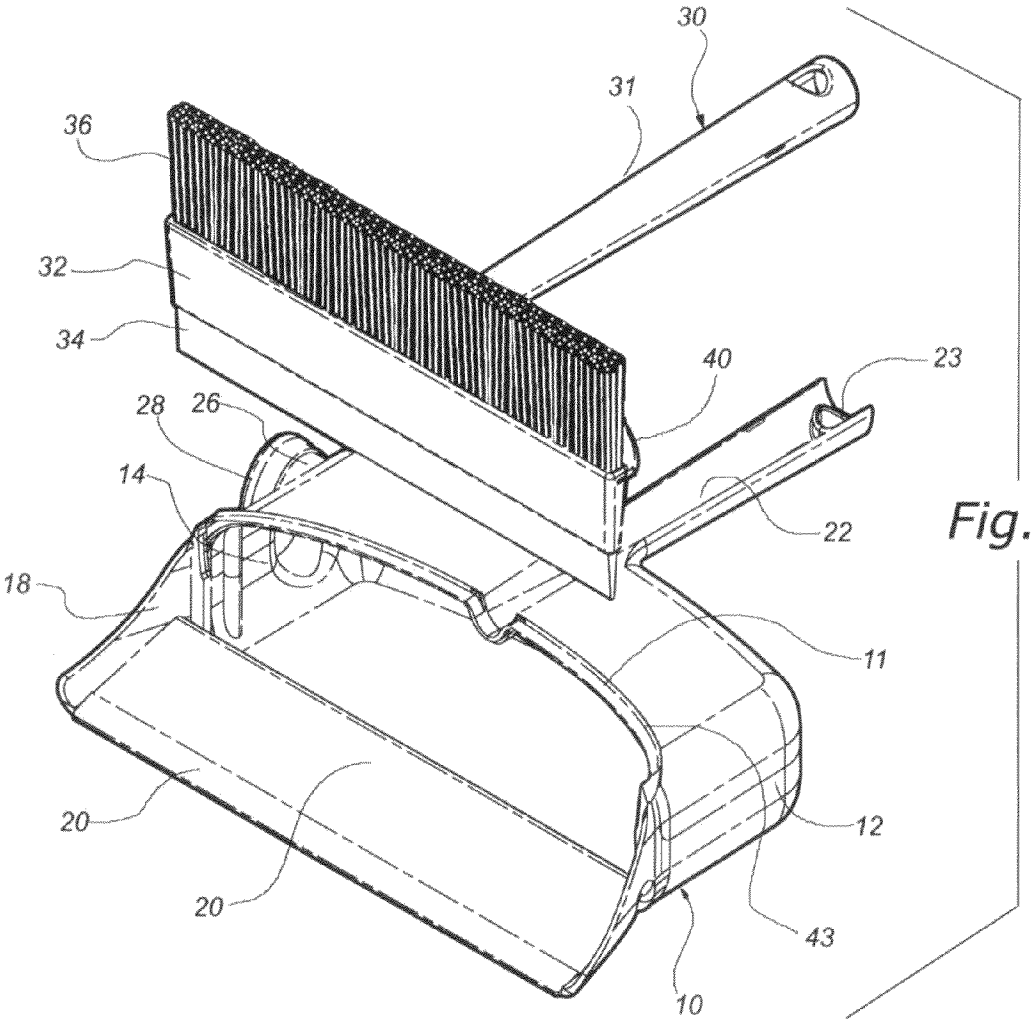
Figure 8:
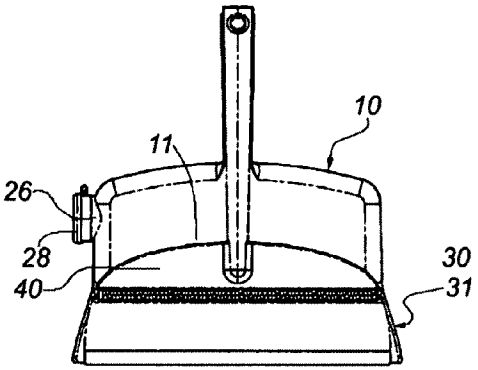
Figure 6:
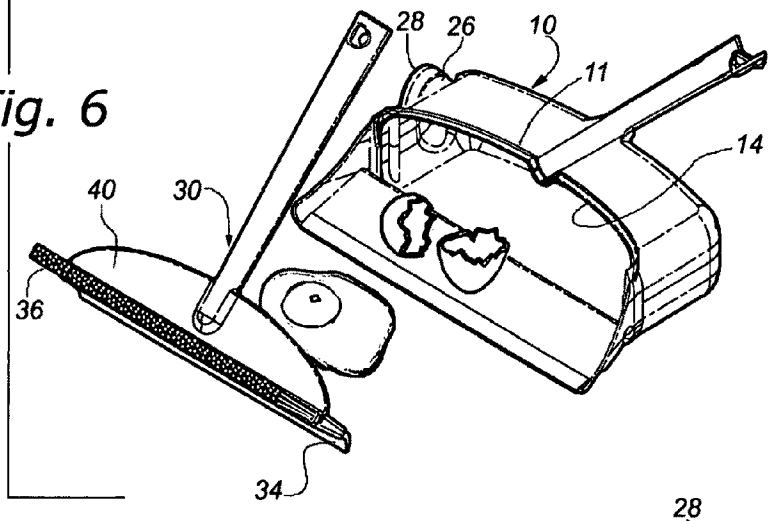
Figure 7:
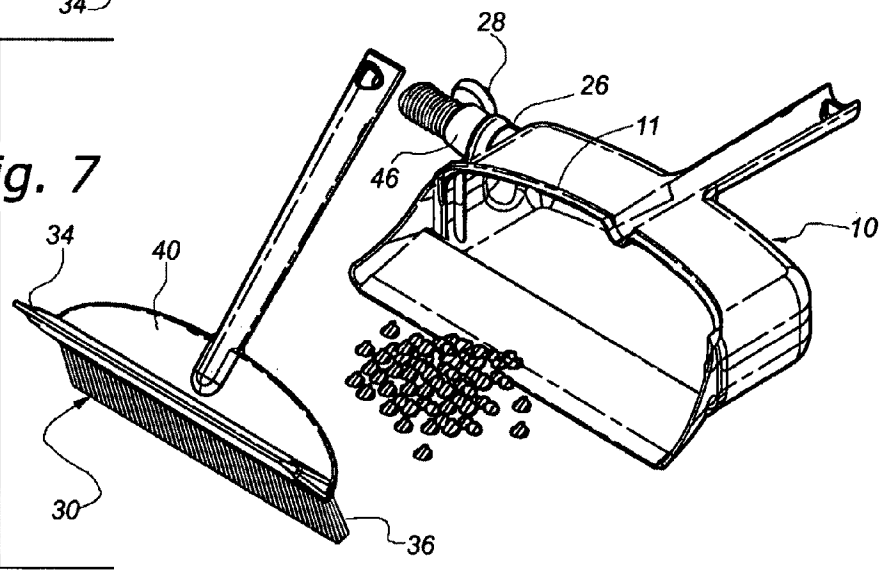
Figures 9, 10, 11, 12A, 12B, 12C:
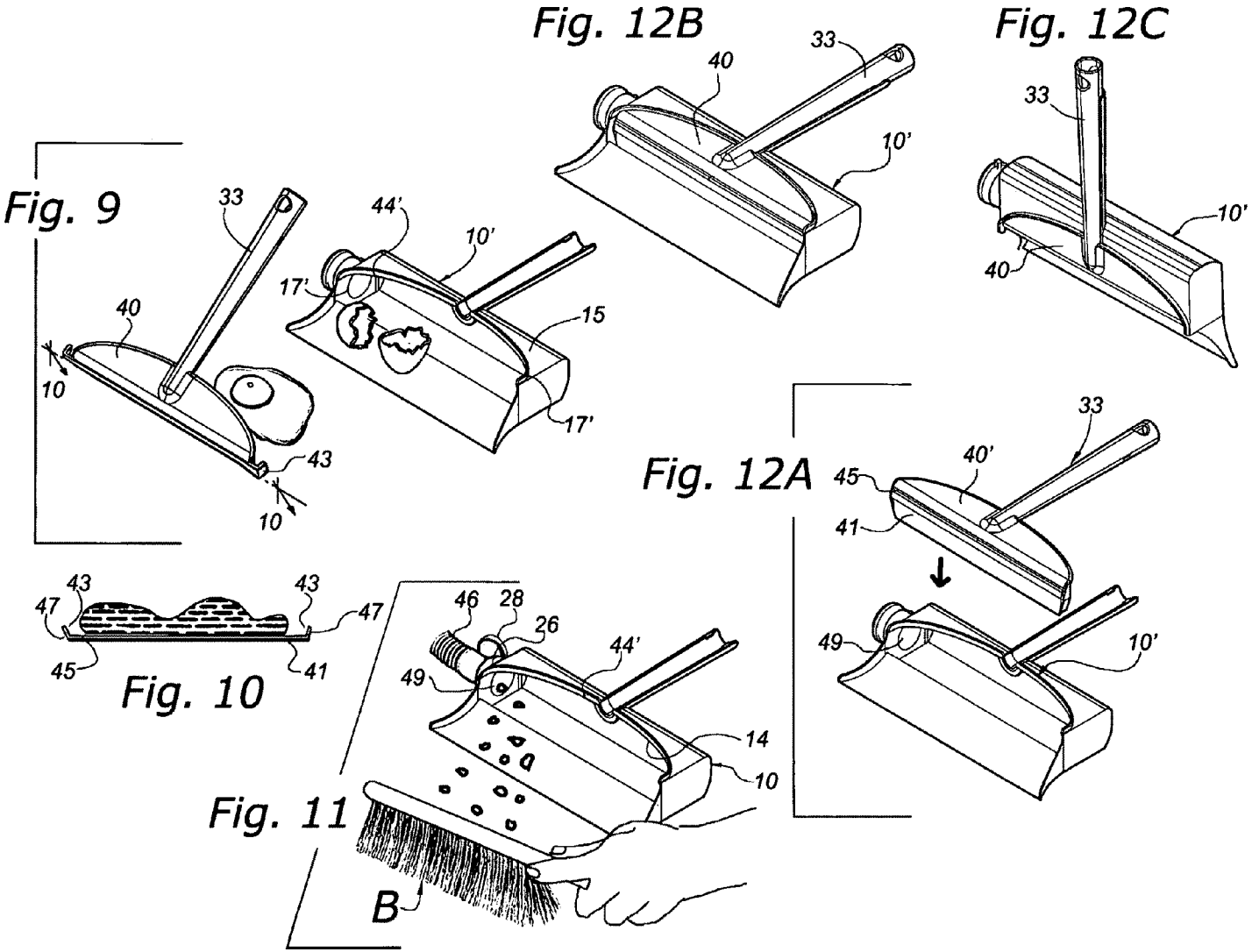
Figure 16:
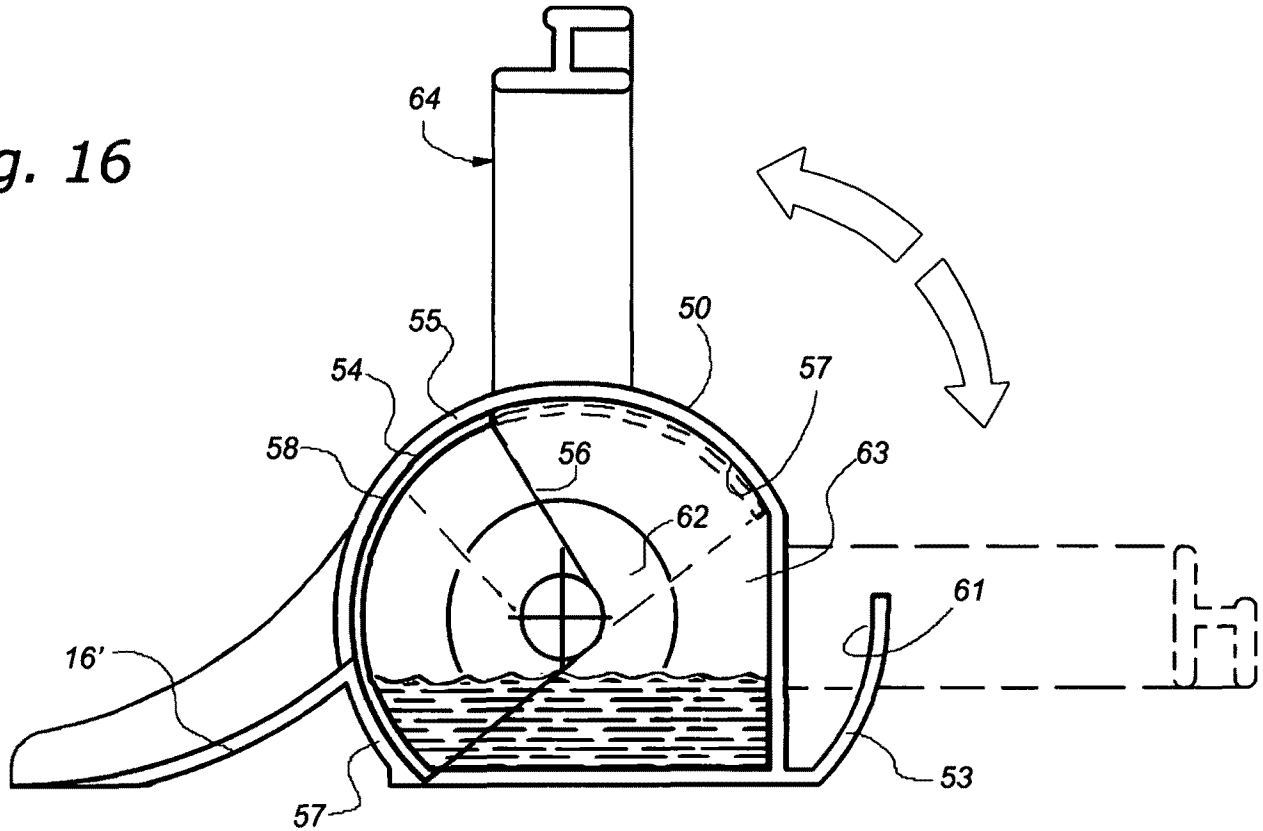
Figures 17, 18, 19:
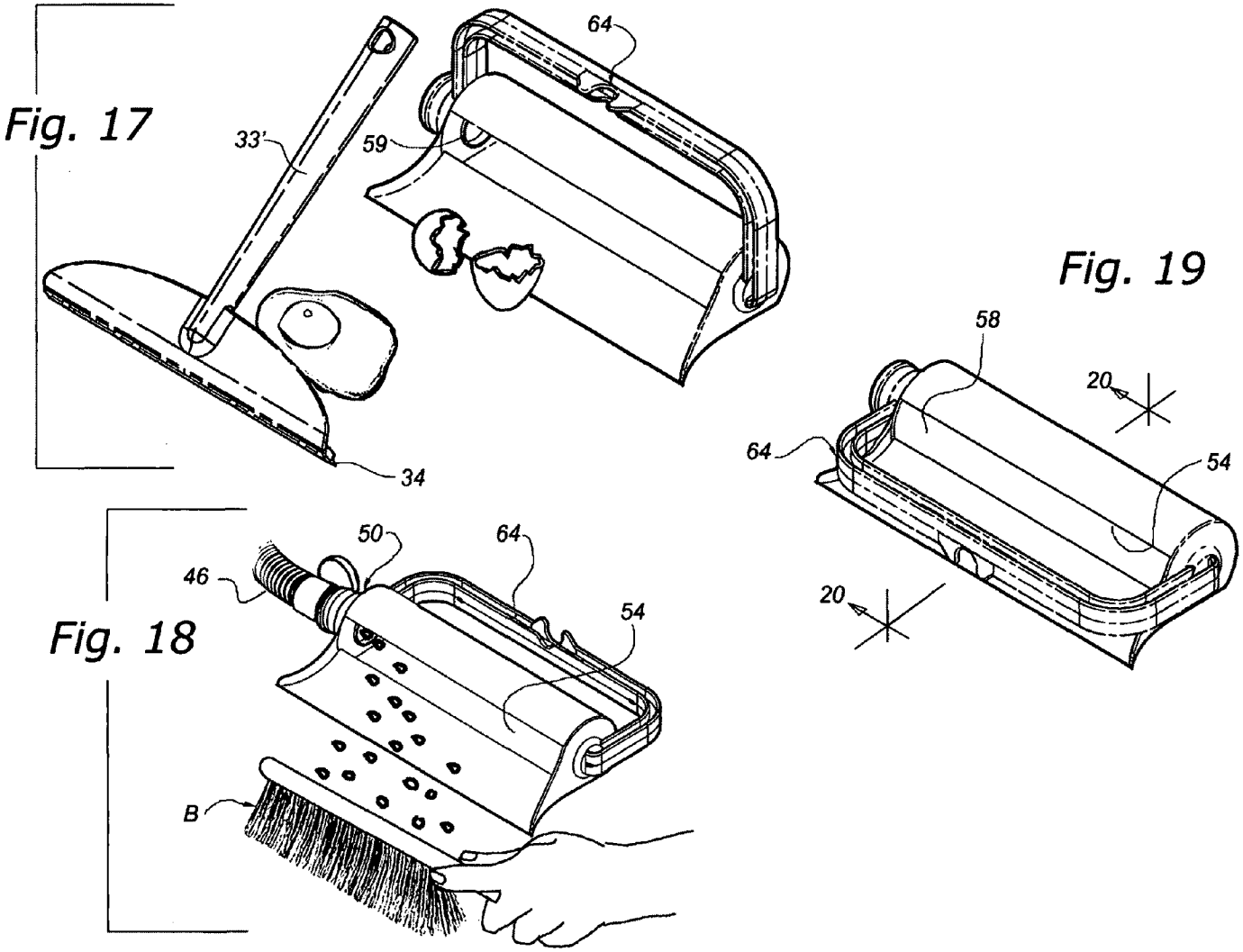
Figure 20:
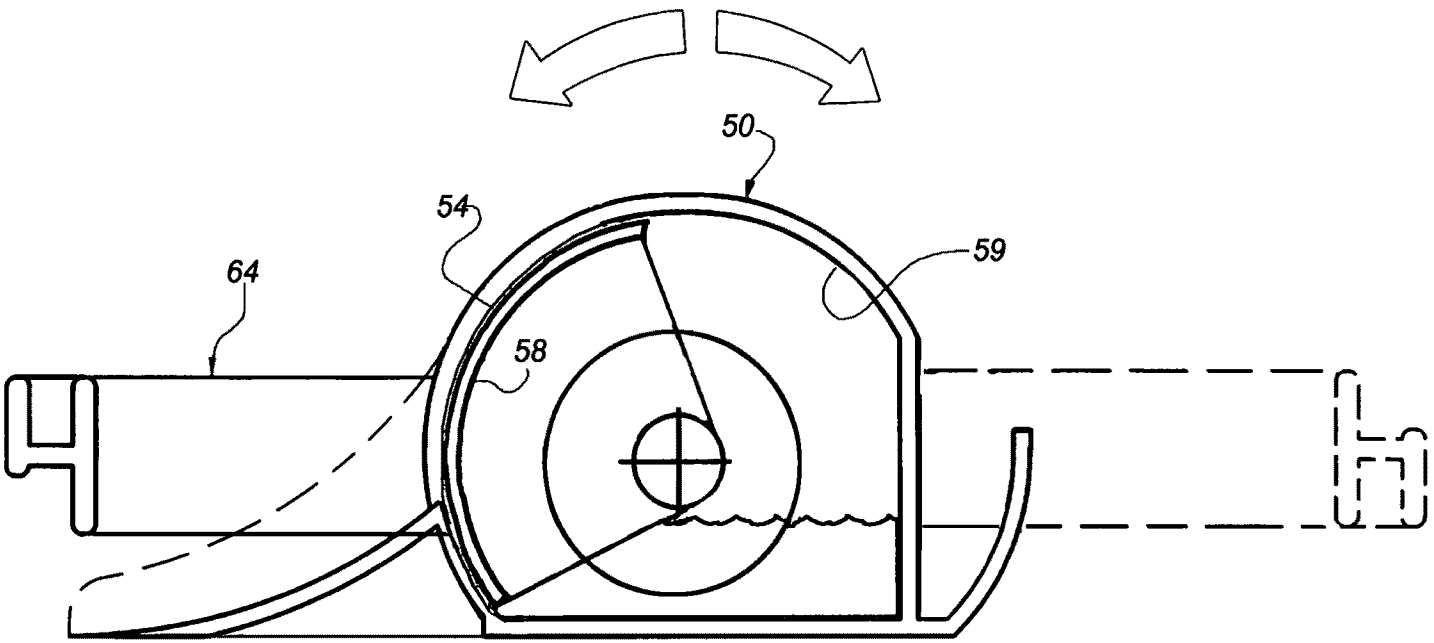
Figure 22B:
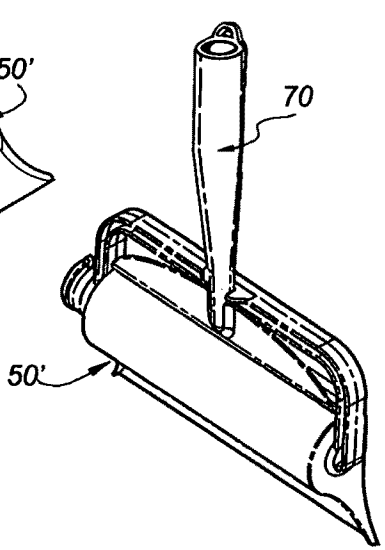
Figure 22A:
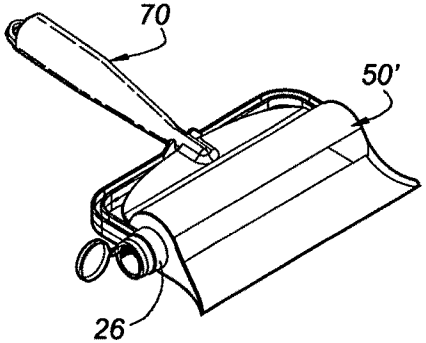
Figure 21:
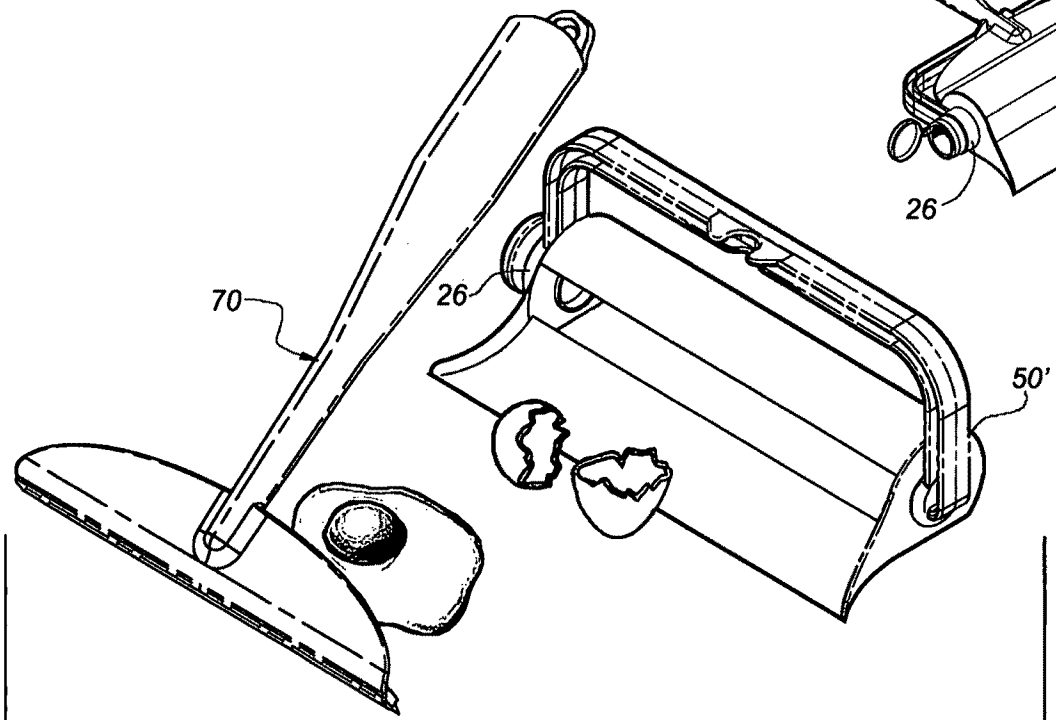
Figure 23:
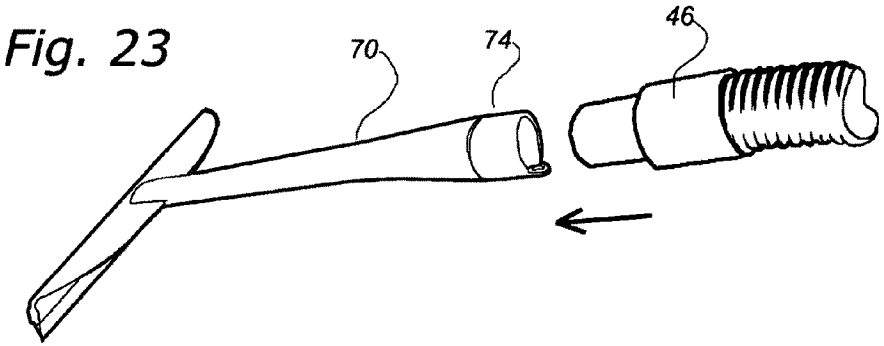
Figure 24:
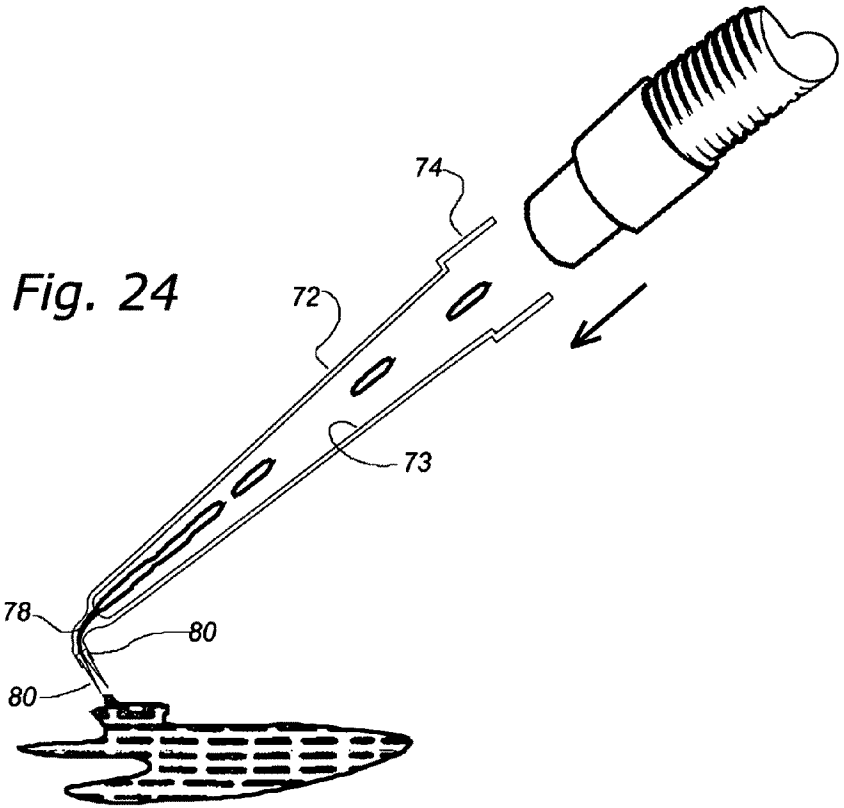
Figure 28:
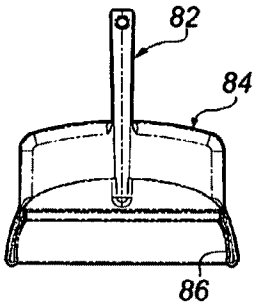
Figure 26:
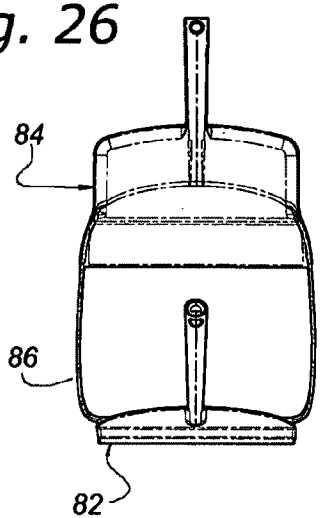
Figure 27:
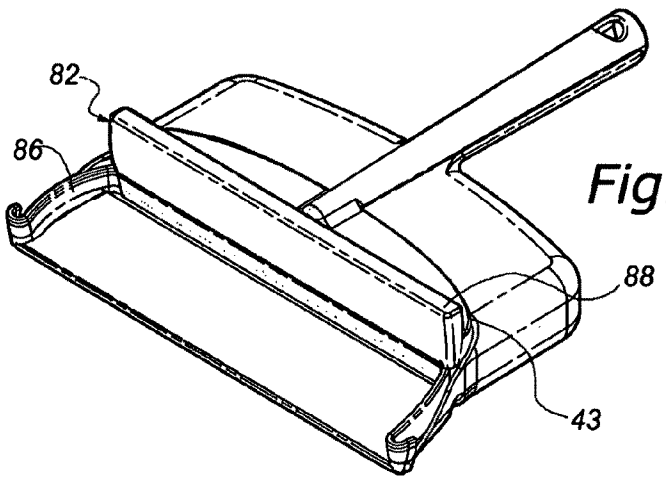
Figure 25:
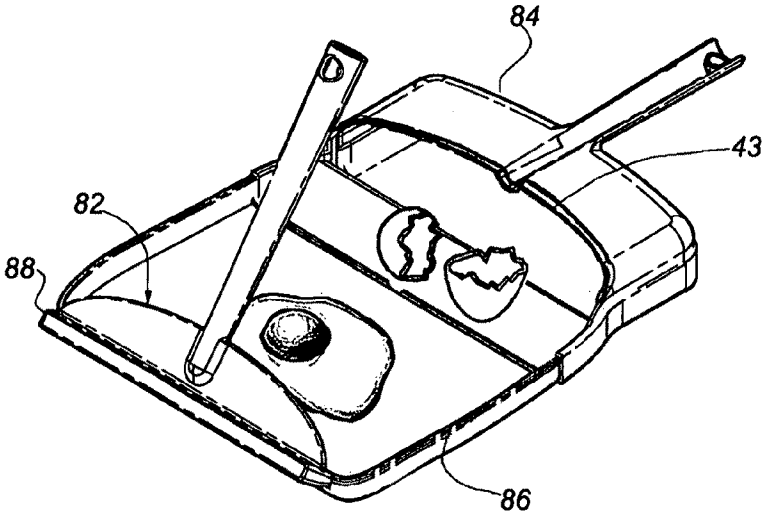
Figures 29, 30, 31, 32, 33:
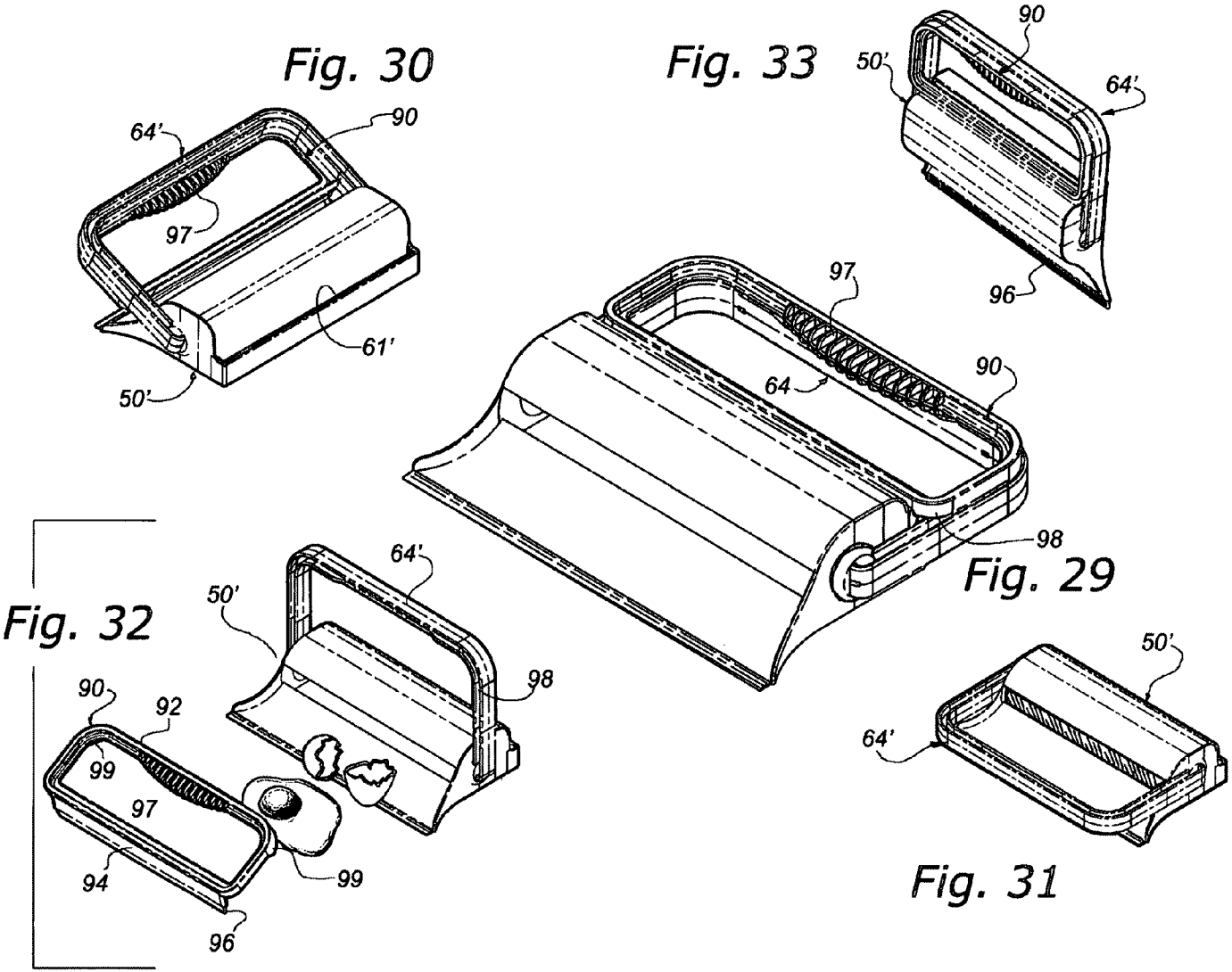
Figure 36:
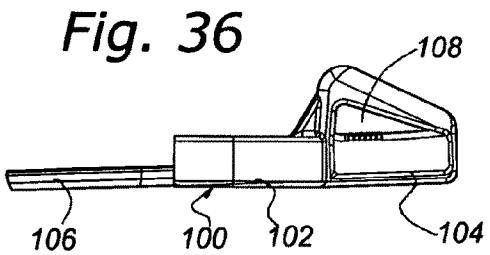
Figure 35:
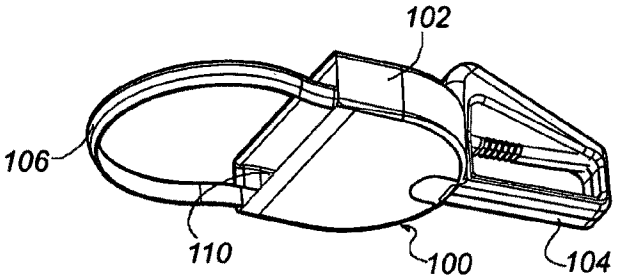
Figure 37:
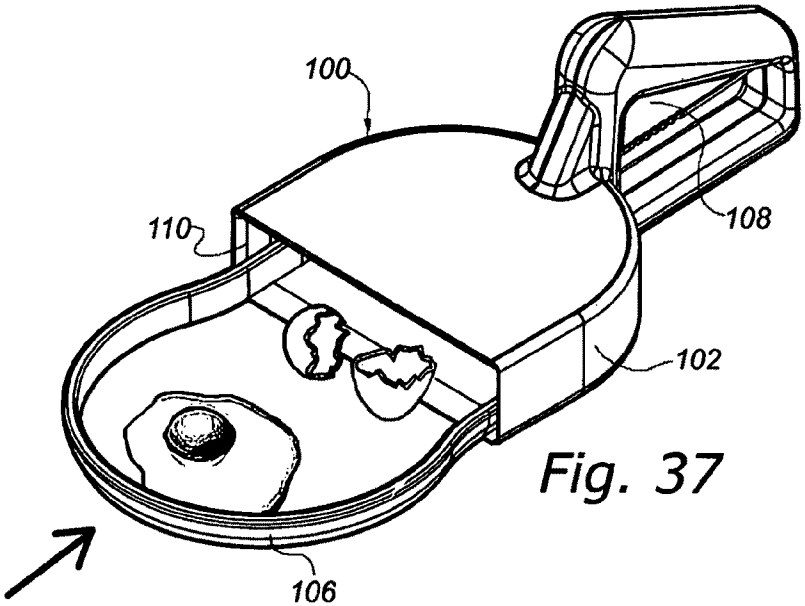
Figure 34:
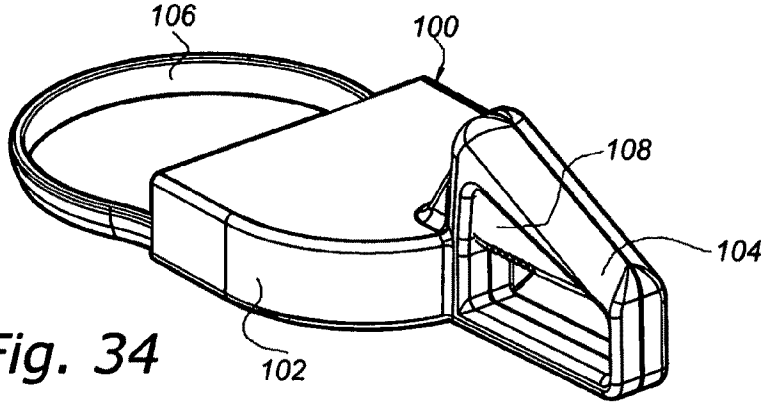
Figures 38, 39, 40:
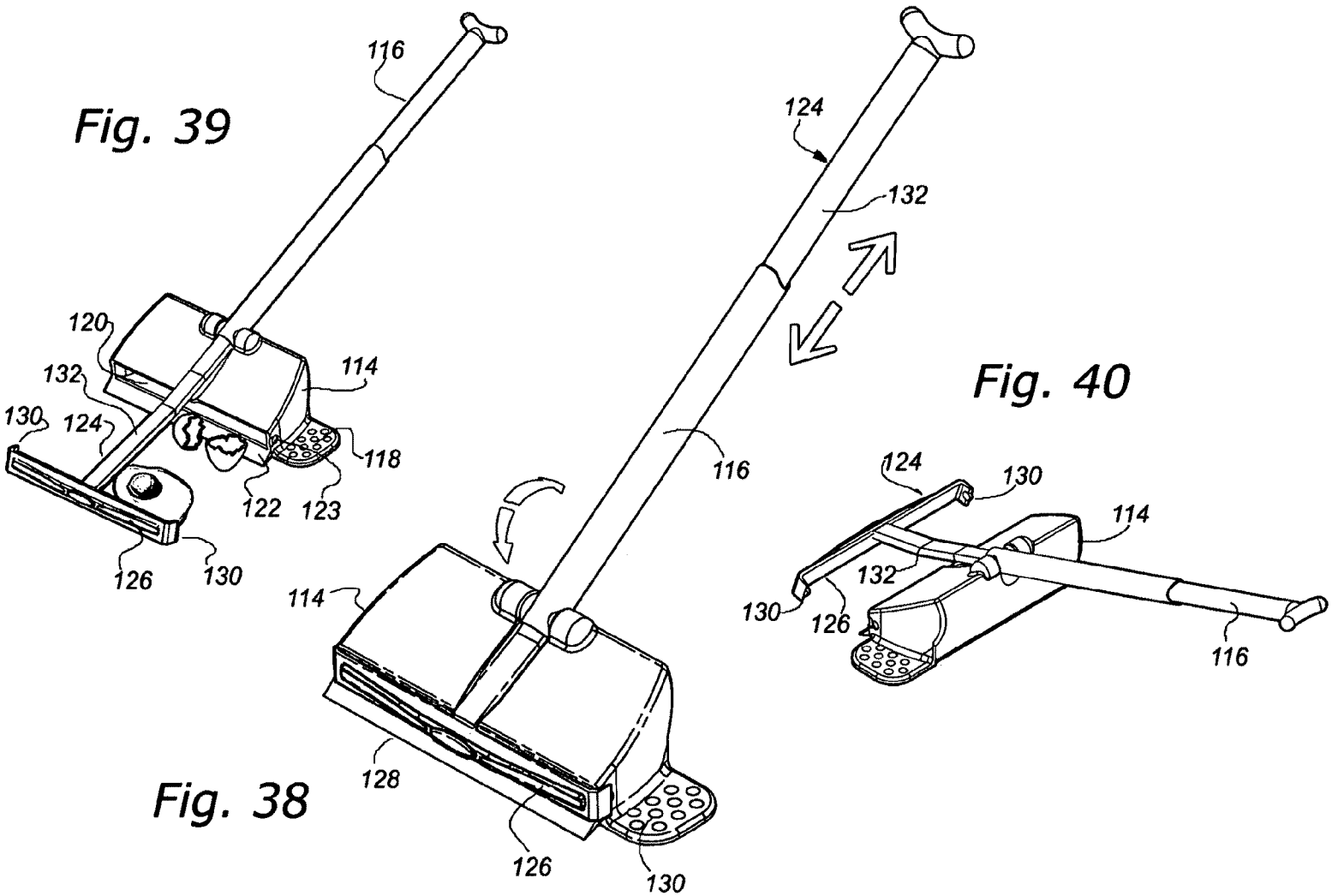
Figure 43:
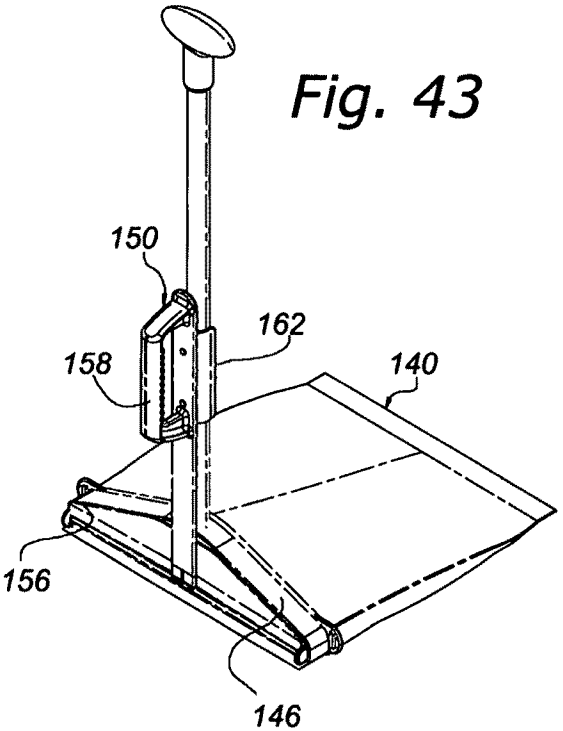
Figure 41:
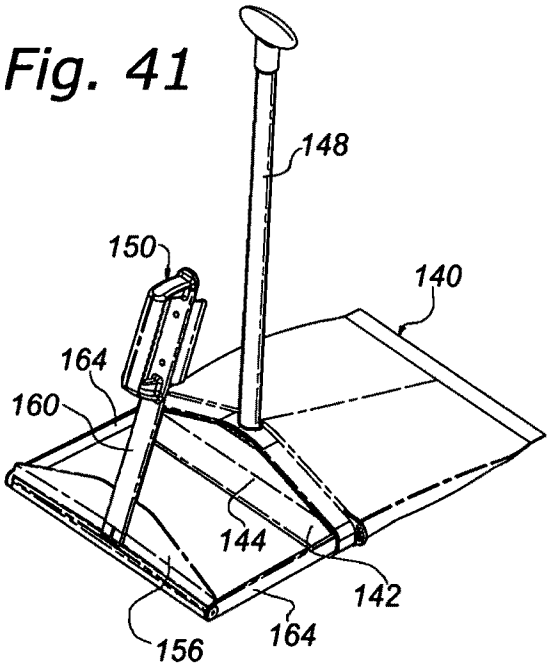
Figure 42:
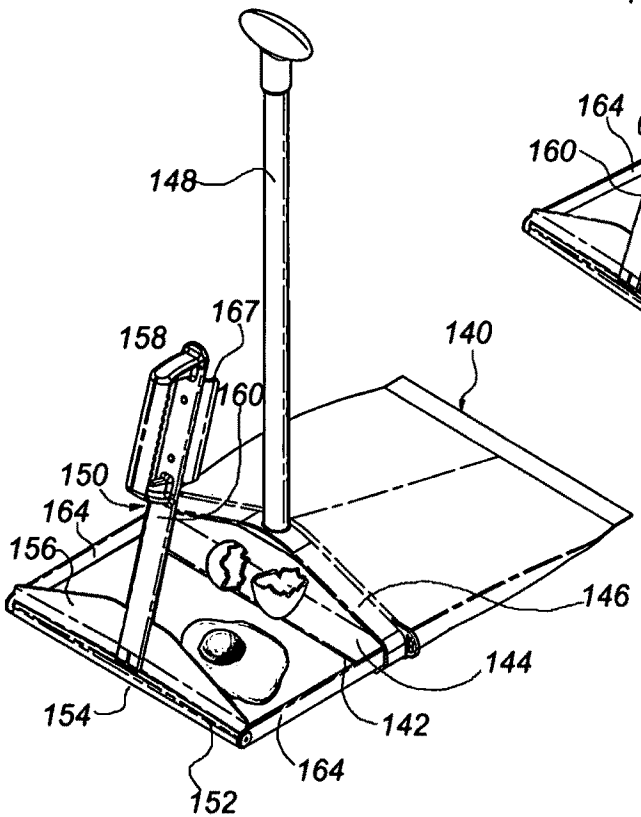
Figure 44:
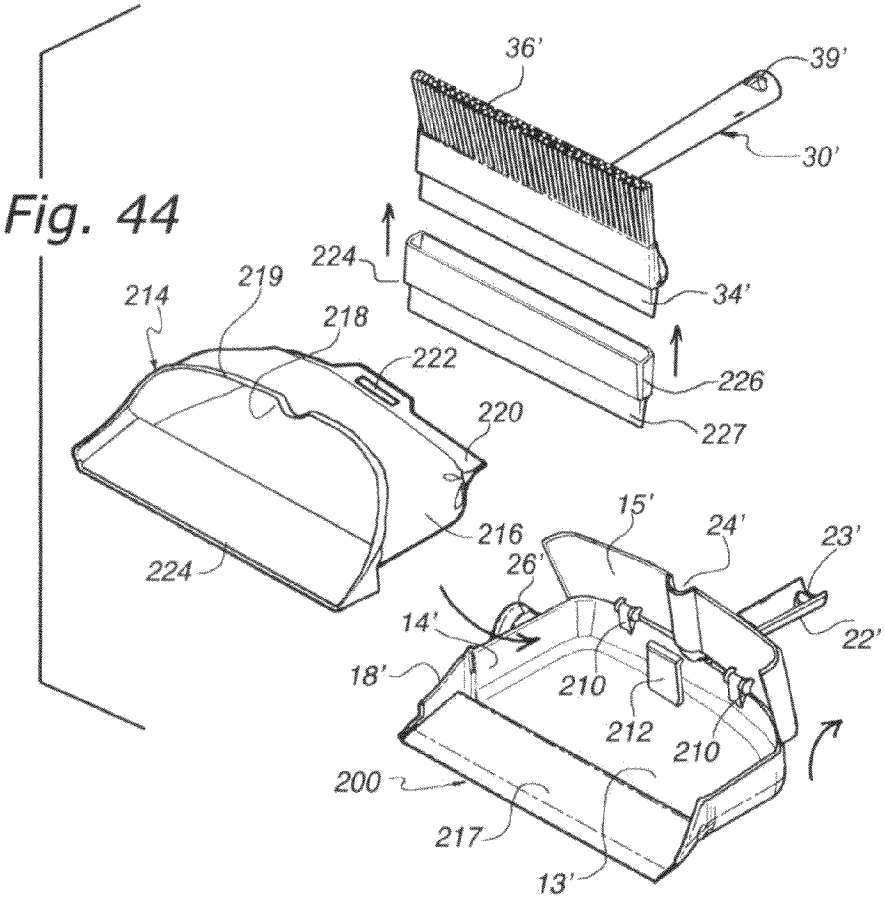
Figure 45:
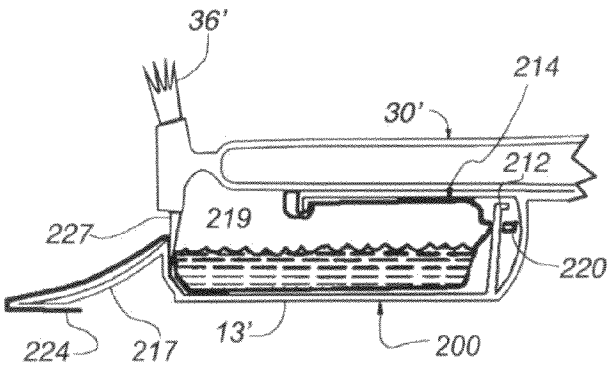

FIGS. 3A, 3B, 3C, and 3D are exploded perspective views of the system of FIGS. 1 and 2, drawn to a reduced scale and taken from various perspectives;

FIG. 4 is a fragmentary sectional view of the system of the foregoing figures, taken along line 4-4 of FIG. 1 and drawn to an enlarged scale;

FIG. 5 is an exploded perspective view of a system embodying the invention, slightly modified from the form depicted in FIGS. 1-4;

FIGS. 6 and 7 are perspective views showing the system of FIGS. 1-4, further modified and in use for the removal of semi-liquid matter and solid matter, respectively, from a surface;

FIG. 8 is a plan view of the system of FIGS. 6 and 7, drawn to a reduced scale and in a storage position;

FIG. 9 is an exploded perspective view of a system embodying the present invention, in use for the removal of semi-liquid matter from a surface, comprised of a squeegee tool and containment unit;

FIG. 10 is a sectional view taken along line 10-10 in FIG. 9 and showing the configuration of the blade portion of the squeegee tool;

FIG. 11 is a perspective view showing the containment unit of the system of FIG. 9, in use with a brush for the removal of solid matter;

FIGS. 12A, 12B, and 12C show the system of FIG. 9, drawn to a reduced scale and (A) with the squeegee tool positioned for assembly with the containment unit, (B) in assembly with the unit, and (C) in assembly and stored position;

FIG. 13 is a perspective view showing a second form of unique cleanup systems, consisting of a squeegee tool and a containment unit, the containment unit including an integral rotating door that closes, by pivoting of its U-shaped handle, to confine matter within its chamber;

FIG. 14 is a perspective view of the containment unit of FIG. 13 with the handle oriented vertically and disposing the door in its closed position;

FIGS. 15A and 15B are perspective and elevational views, respectively, of the system of FIGS. 13 and 14 in a stored position;

FIG. 16 is a cross sectional view, taken along lines 16-16 of FIG. 14, drawn to an enlarged scale and showing (in full line) the rotating door turned to its closed position;

FIG. 17 is a perspective view, similar to FIG. 13, showing a slightly modified form of the containment unit in which the door is in open position when the handle is disposed vertically, the system, as shown, being employed for the removal of semi-liquid matter;

FIG. 18 is a view similar to FIG. 17, showing the containment unit with its door open in a second orientation of the handle, showing connection to a vacuum system hose, and being employed for the receipt of solid matter swept thereinto using a separate brush;

FIG. 19 is a perspective view of the containment unit of FIGS. 17 and 18, showing the door in its closed position with the handle pivoted to a generally horizontal, forward orientation;

FIG. 20 is a view similar to FIG. 16, taken along line 20-20 of FIG. 19;

FIG. 21 is an exploded perspective view of an embodiment of the system of the invention in which the squeegee tool handle provides an air-flow passage and is adapted to receive a vacuum hose;

FIGS. 22A and 22B are perspective views of the system of FIG. 21, drawn to a reduced scale and showing the squeegee tool and containment unit in assembly;

FIG. 23 is a perspective view showing the squeegee tool of the embodiment of FIG. 21, aligned for the receipt of a vacuum system hose;

FIG. 24 is a view similar to FIG. 23 but showing the squeegee tool in cross section;

FIG. 25 is a perspective view showing a further embodiment of the system of the invention, wherein a flexible belt or band integrates the squeegee tool and the containment unit, the components being displaced from one another;

FIG. 26 is a plan view of the same system, as depicted in FIG. 25 and drawn to a reduced scale;

FIGS. 27 and 28 are perspective and plan views, respectively, of the system of FIGS. 25 and 26, wherein the squeegee tool and containment unit are interengaged in a mated closed relative position;

FIG. 29 is a perspective of another embodiment of a novel cleanup system in which the squeegee tool is dimensioned and configured to conform to and engage with the U-shaped handle of the containment unit;

FIG. 30 is a rear perspective view of the system of FIG. 29, drawn to a reduced scale and showing the handle and the contained squeegee tool inclined forwardly from an upright orientation;

FIG. 31 is a front perspective view of the system of FIGS. 29 and 30, showing the handle and assembled squeegee tool oriented in a fully forward (normally horizontal) position in which the door of the containment unit closes the internal chamber;

FIG. 32 is a perspective view of the system of FIGS. 29-31, showing the squeegee tool removed from the handle and in use for clearing away semi-liquid matter;

FIG. 33 is a perspective view, drawn to a reduce scale, showing the system of FIGS. 29-32 in a storage position;

FIG. 34 is a rear perspective view of yet another embodiment of novel cleanup systems which includes a flexible band, or recoil loop, that can be drawn mechanically into the containment unit to function in the manner of a squeegee tool;

FIGS. 35 and 36 are bottom and side-elevational views of the system of FIG. 34, drawn to a reduced scale;

FIG. 37 is a front perspective view of the system of FIGS. 34-36, shown in use to effect removal of semi-liquid matter;

FIGS. 38-40 are perspective views of still another embodiment of the system of the present invention, wherein the squeegee tool has a stem that is slideably engaged within a tubular handle, pivotably attached to the containment unit, and wherein the head member of the tool closes the entrance to the containment unit;

FIGS. 41-43 are perspective views of a yet a further embodiment of the system of the invention, comprised of pivoting squeegee tool and a bag-like containment unit, interconnected by slidably-received lateral guide and confinement strips;

FIG. 44 is an exploded perspective view showing components of a modified form of a system of the kind illustrated in FIGS. 1 through 12, wherein the containment unit includes a replaceable bag-like insert;

FIG. 45 is a view of the assembled system of FIG. 44, taken in cross section.

Figure 47:
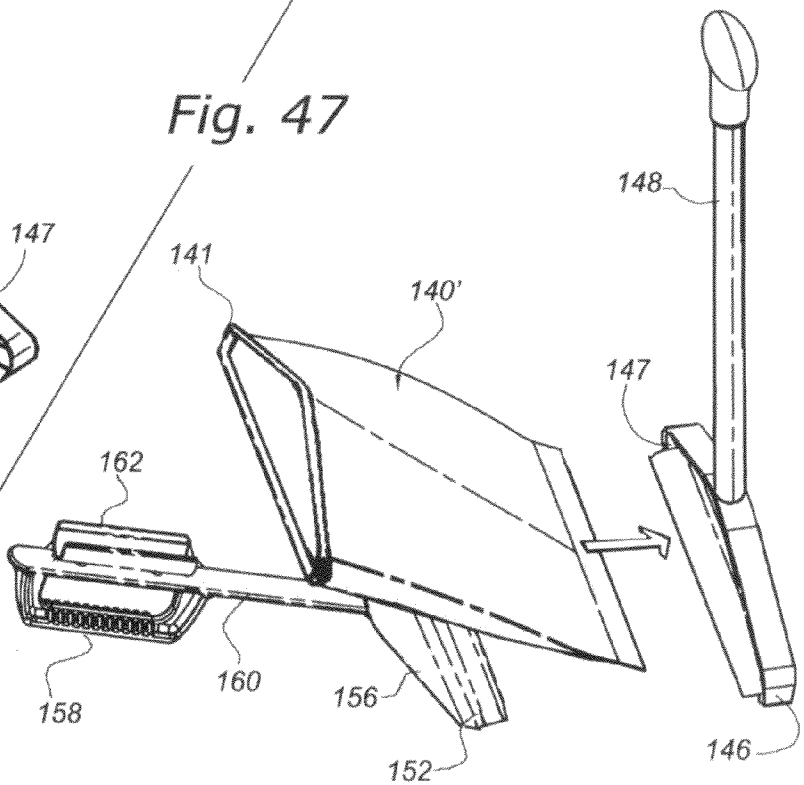
Figure 46:
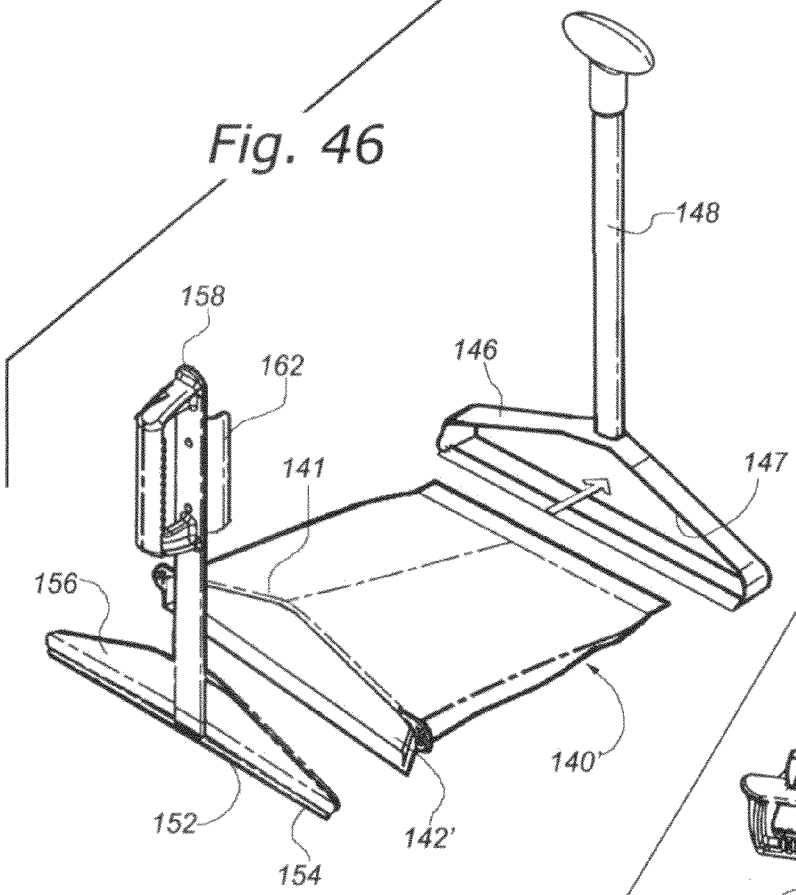
Figure 48:
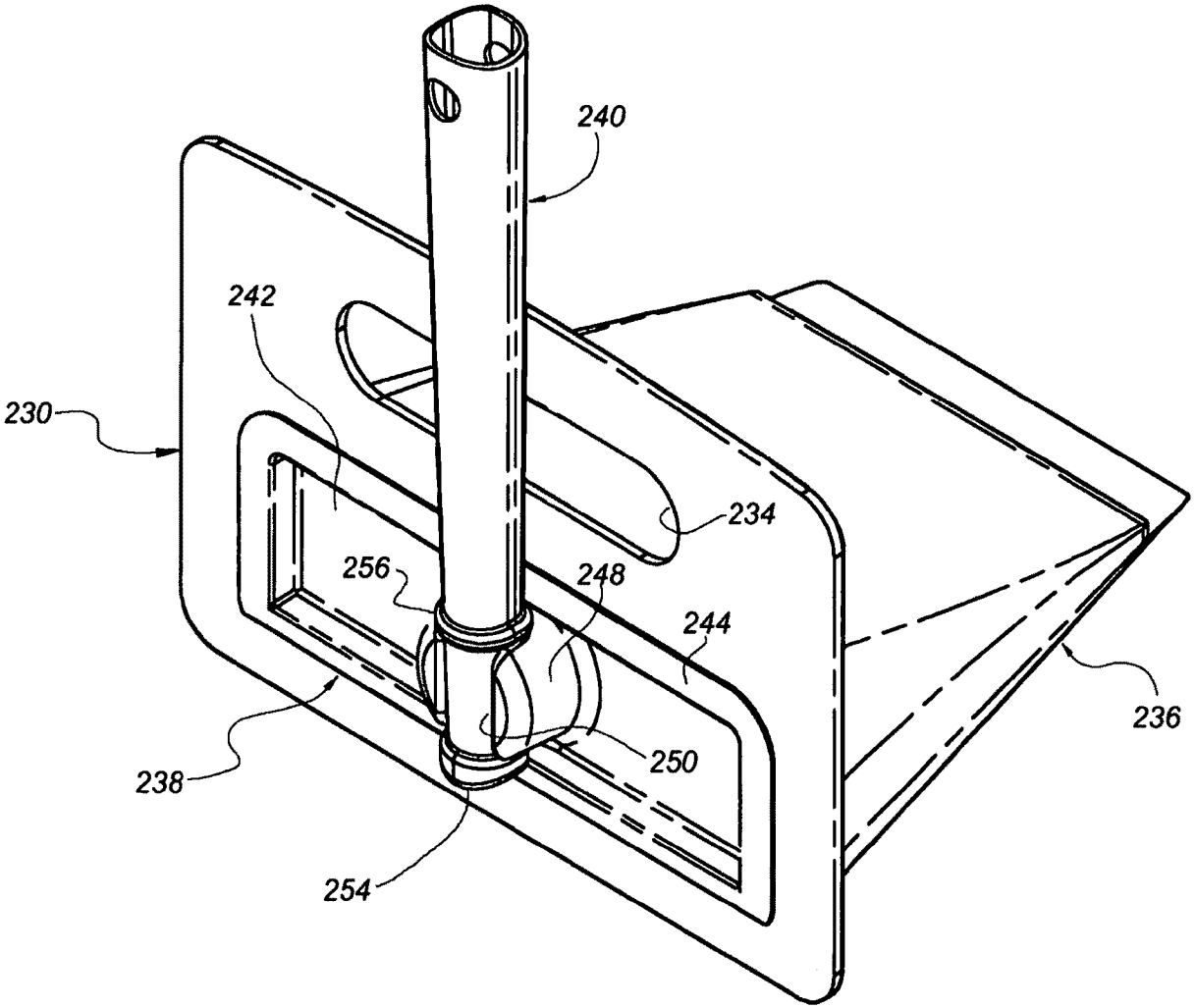

FIGS. 46 and 47 are exploded perspective views showing components of a modified form of a system of the kind illustrated in FIGS. 41 through 43, wherein the bag-like containment unit is removable from the supporting frame;

FIG. 48 is a perspective view of yet another embodiment of the invention, wherein a bag-like container is affixed to generally planar front structure, with which is associated a squeegee tool comprised of a head member and a removable handle.

Figures 49, 50:
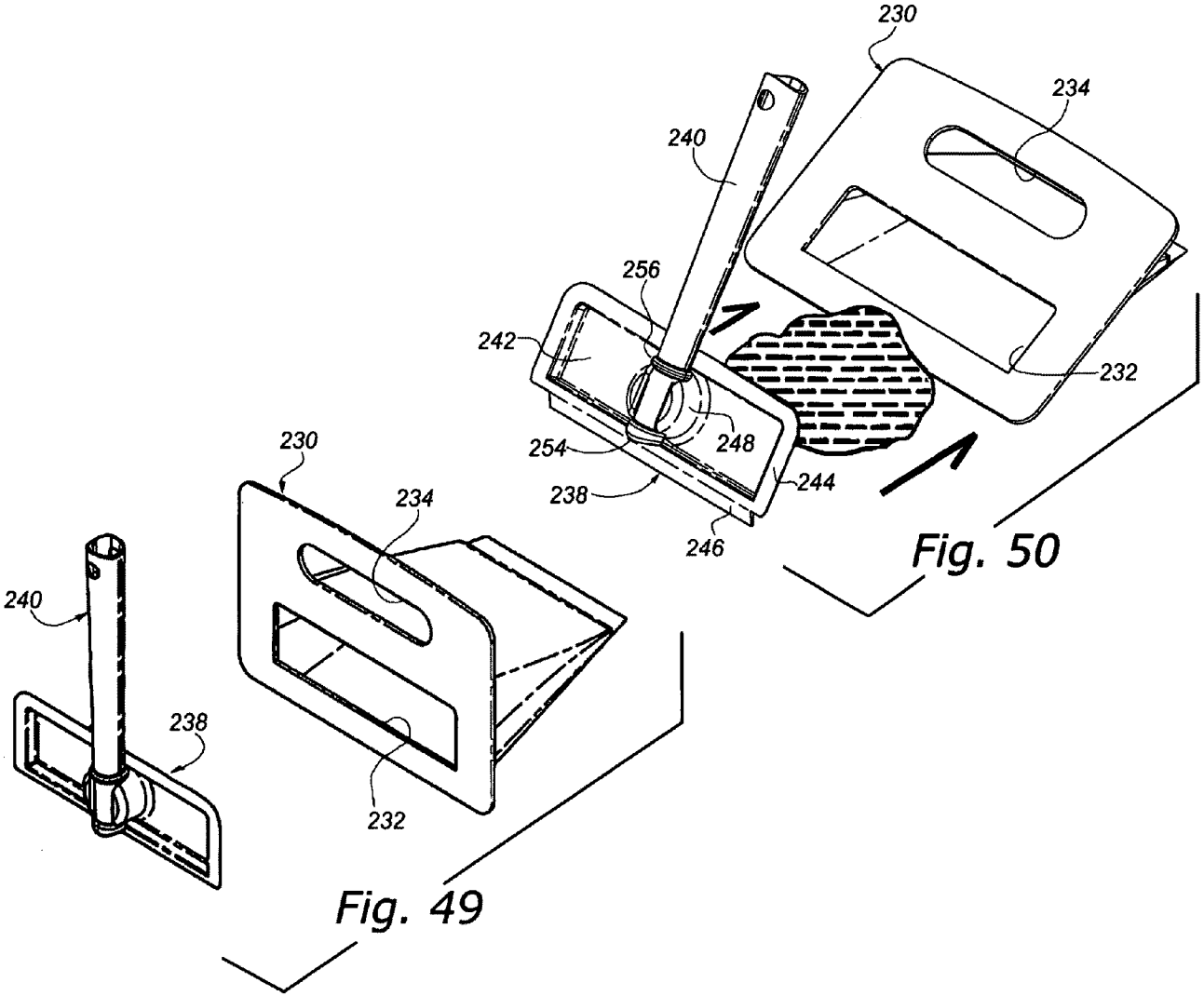
Figure 52:
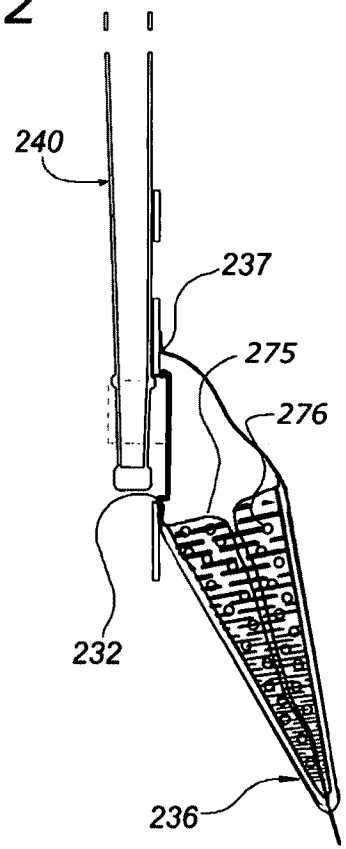
Figure 51:
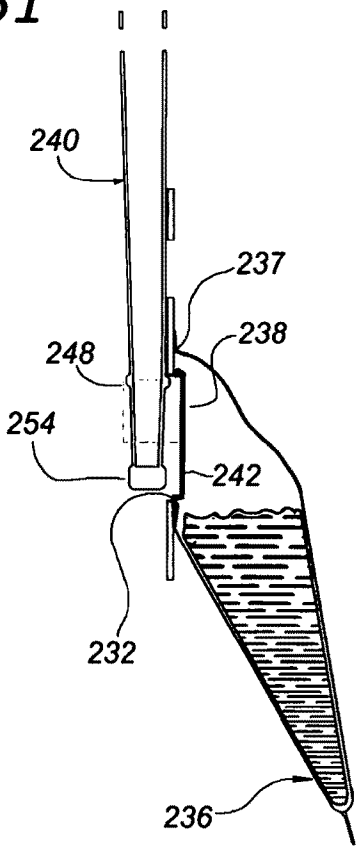
Figure 53:
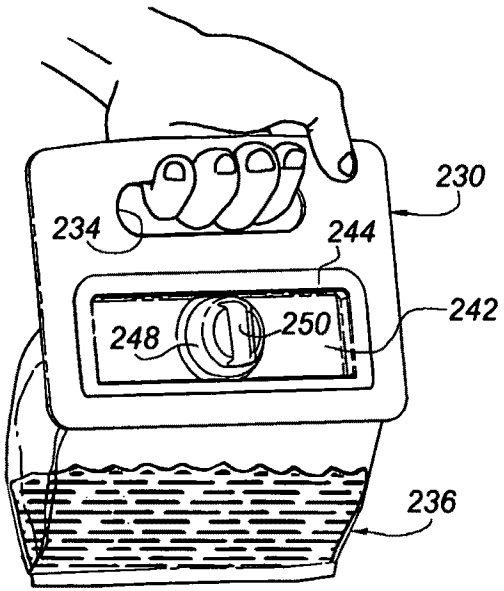
Figure 55:
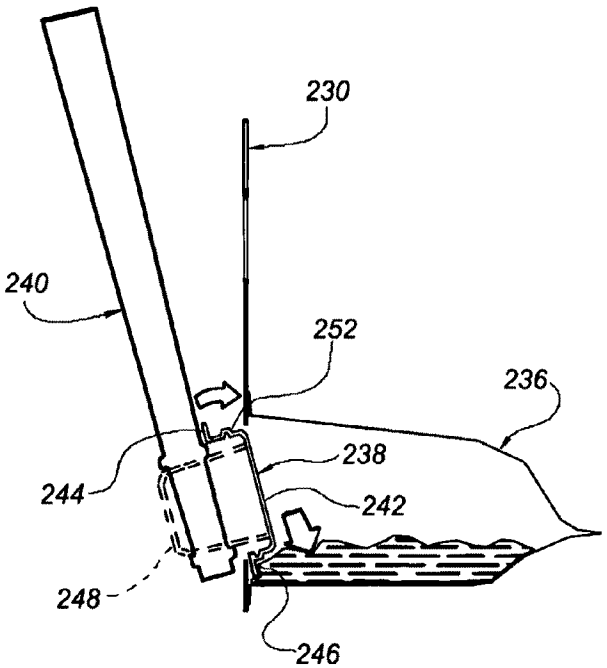
Figure 54:
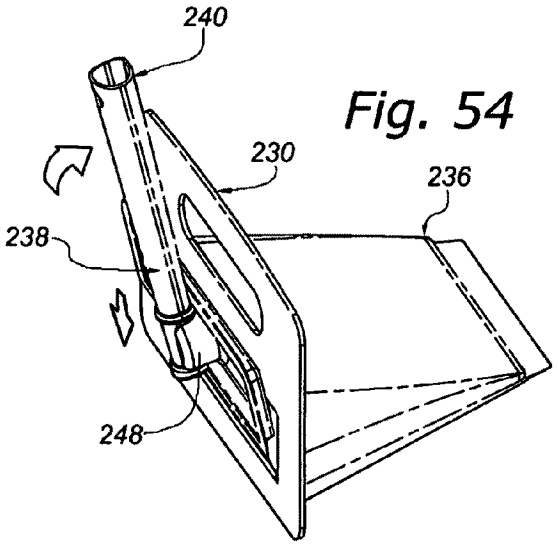
Figure 56:
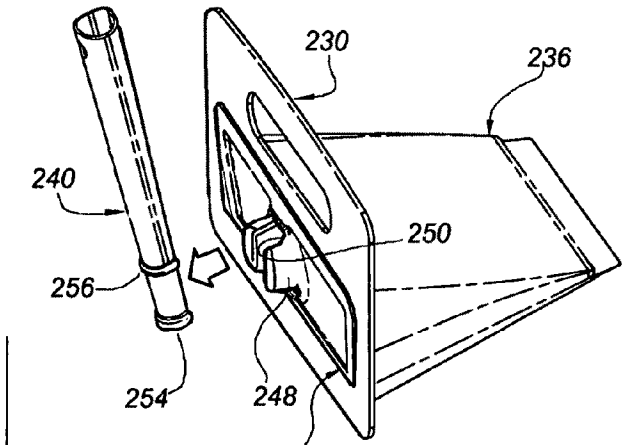
Figure 60:
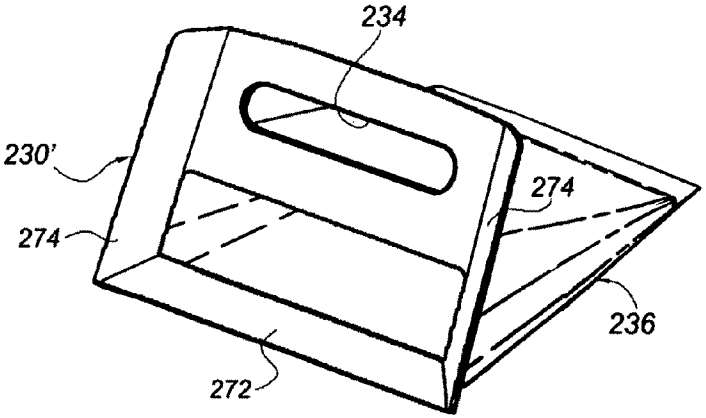
Figure 58:
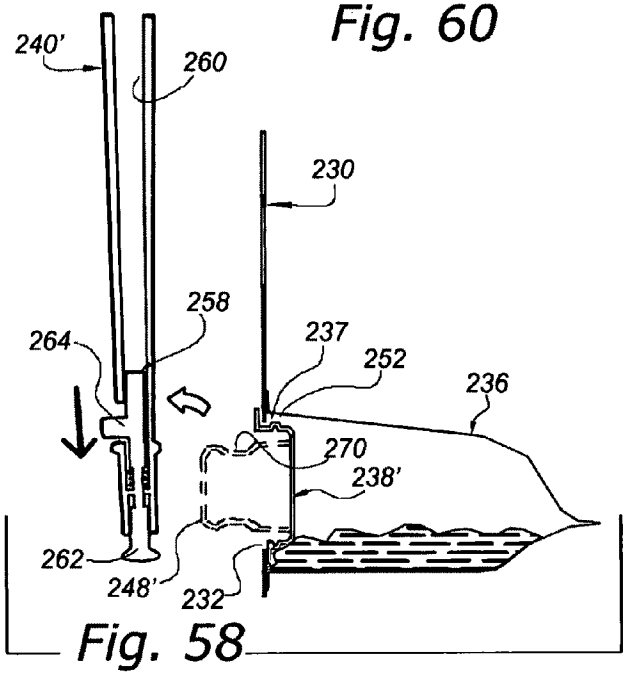
Figure 59:
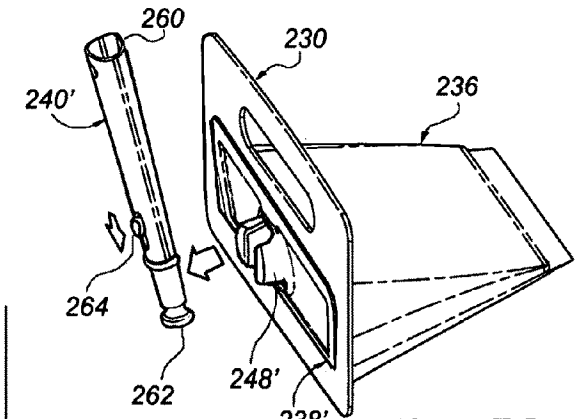
Figure 57:
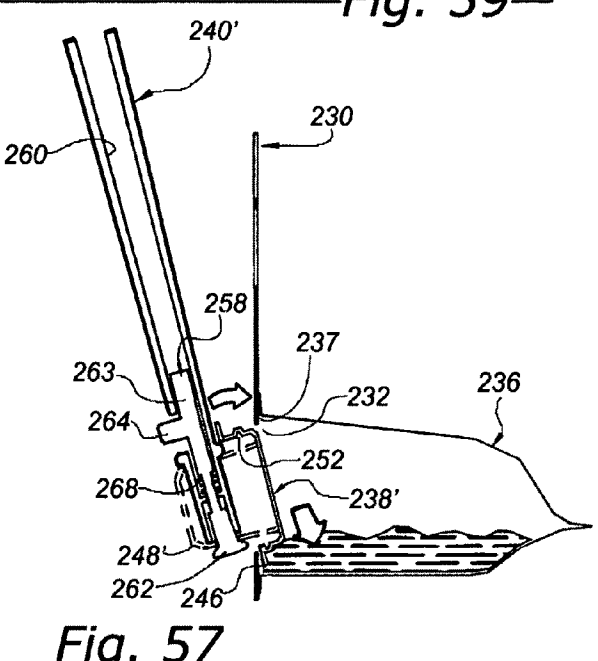

FIGS. 49 and 50 are perspective views of the system of FIG. 48, drawn to reduced scales, showing the squeegee tool removed from the containment unit and, in FIG. 50, showing it in use for clearing away semi-liquid matter;

FIG. 51 is a sectional view showing the system of FIGS. 48 through 50 in which the container is filled with matter and elevated from any supporting surface;

FIG. 52 is a view similar to that of FIG. 51, but wherein the bag-like receptacle itself contains a bag or other insert filled with an absorbent material;

FIG. 53 is a front perspective view showing components of the system of FIGS. 48 through 52 being carried for disposal of contained matter;

FIG. 54 is a perspective view showing the clearing tool, of the preceding figures, being assembled with the containment unit;

FIG. 55 is a cross sectional view depicting the same stage of assembly;

FIG. 56 is a view similar to FIG. 54, wherein the head member of the clearing tool is attached to the containment unit and the handle has been removed;

FIG. 57 is a view similar to that of FIG. 55, but wherein the handle incorporates a locking, or engaging, mechanism;

FIG. 58 is a view similar to that of FIGS. 55 and 57, with the handle removed and with the locking mechanism depressed for enabling removal;

FIG. 59 is a perspective view of the system of FIGS. 57 and 58, showing the handle removed from the head member; and FIG. 60 is a perspective view showing an alternative form of the front structure employed in the containment unit of FIGS. 48 through 59.

DETAILED DESCRIPTION OF THE ILLUSTRATED AND EMBODIMENTS

It will be appreciated that, where common reference numbers are employed in the several embodiments described and illustrated in this specification, the elements referenced are the same or similar throughout. Similarly, where primed reference numbers are employed, the components are similar to components referenced by the same unprimed number.

Turning initially to FIGS. 1-4 of the drawings, therein illustrated is a first embodiment of the cleanup system of the invention and consisting of a containment unit, generally designated by the numeral 10, and a squeegee tool generally designated by the numeral 30. The containment unit comprises a containment body 12 that defines an interior chamber 14 to which an inclined ramp 16 leads. Low lateral wall elements 18 extend along the sides of the ramp 16 and curve inwardly to confine and direct matter being moved into the chamber 14. The ramp terminates in a flexible lip element 20 that extends across its forward edge, and a front wall section 21, that is generally vertical in normal use, joins the ramp 16 to the forward part of the bottom wall structure 13 that cooperatively defines the containment body 12.

A handle 22, of generally semicircular cross section, extends rearwardly from the containment section 12; it forms an extension of the semi-circular groove-defining structure 24 that is formed into the top wall 15 of the containment body 12. A short coupling collar 26 projects a from one lateral wall 17 of the containment body 12, and receives a removable (but tethered) cap 28 (shown in its overlying position in these figures); the collar 26 surrounds a clean-out and/or material discharge opening from the chamber 14, and additionally serves for the receipt of a vacuum hose.

The squeegee tool 30 includes an elongated head 32, from the opposite, longer, parallel margins of which extend an elongate blade element 34 of flexible, rubbery material (as is typical of a squeegee tool), and an elongate brush element 36. A flat shoulder plate 40, having a semi-elliptical peripheral edge, extends rearwardly from the head 32, intermediate its long margins, and a handle 38 extends rearwardly from the shoulder plate 40, centrally of and normal to the head 32. A gasket element 42, of conformable rubbery material (e.g., vinyl plastic) extends along the entire peripheral edge of the shoulder plate 40.

As can be seen with particular clarity from FIGS. 1 and 4, when the squeegee tool 30 is assembled with the containment unit 10, the tool handle 38 seats in the semicircular handle section 22 and groove structure 24 of the containment body 12. This causes the blade element 34 on the squeegee tool 30 to extend along, and to bear tightly against, the vertical wall section 21 at end of the ramp 16. The gasket element 42 on the peripheral edge of the shoulder plate 40 of the tool 30 simultaneously engages, and bears tightly against, the adjacent, mated marginal portion of the containment body 12 at the entrance to the interior chamber 14; it will be noted that the marginal portion of the body 12 is formed with a narrow depending lip 44, spanning the chamber entrance, to increase the contact area. An upstanding boss 23 on the containment unit handle section 22 seats in a hole 39 in the tool handle 38 to maintain the components in firm interengagement. This feature cooperates with the mating tapers of the handle section 22 and groove 24 of the containment body 12, and the handle 38 of the squeegee tool, to ensure that the blade and gasket elements 34, 42 will be maintained in a tight relationship against the wall section 21 and the lip 44, respectively, thus effectively sealing the chamber 14 and forming a liquid-tight enclosure from which semi-liquid, or fully liquid, matter can not normally escape.

The system depicted in FIG. 5 is substantially the same as that of FIGS. 1-4, with the exception that, rather than providing the sealing gasket element 42 on the shoulder plate 40 of the squeegee tool 30, a gasket element 43 is affixed to the mating edge of the containment unit, generally designated by the numeral 11, so as to surround, on three sides, the entrance to the chamber 14 thereof. The shoulder 40 of the squeegee tool, generally designated by the numeral 31, is correspondingly devoid of any gasket element on its peripheral edge. The same sealing effect will of course be achieved when the squeegee tool, generally designated by the numeral 31, is assembled with the containment unit 11, in the manner depicted in FIGS. 1 and 4.

FIG. 6 depicts a system comprised of the containment unit 10 and the squeegee tool 31 (i.e., no gasket element is provided on either component), utilized with the blade element 34 operative for effecting the removal of a semi-liquid material. FIG. 7 shows the same tool 31, rotated to position the brush element 36 for sweeping solid matter into the chamber 14 of the containment body 12. FIG. 7 additionally shows the cap 28 displaced from the coupling collar 26 (surrounding an opening in one of the lateral walls 17 of the containment body 12) to accept the attached vacuum hose 46, thereby causing material swept into the chamber 14 to be drawn into an associated vacuum machine (not illustrated, but taking any suitable form, such as of a conventional dry vacuum cleaner or a wet vacuum system).

FIG. 8 shows the squeegee tool 31 in assembly with the containment unit 10. It will be appreciated that, because of the close conformity of the mating surfaces, the internal chamber of 14 of the body 12 is closed (albeit perhaps not optimally sealed, due to the absence of gaskets).

The system depicted in FIGS. 9 through 12 is similar to those hereinabove described, but incorporates a number of modifications. Most notably, and as is best seen in FIG. 10, the head of the squeegee tool, generally designated by the numeral 33, consists of a shoulder plate 40' and a depending forward flange 45 having rearwardly directed tab-like elements 43 on its bottom portion. The blade portion 41 incorporates lateral elements 47, which cooperate with tab-like elements 43 and help to confine the semi-liquid matter (depicted as a broken egg) and to minimize leakage or escape past the opposite ends of the blade portion 41. The tool is devoid of any brush-like feature.

As can also be seen, the containment unit 10' is formed to have an upstanding lip 44' on the top wall 15, which cooperates with the peripheral edge of the shoulder plate 40' of the squeegee tool 33 so as to effect closure of the mouth of the internal chamber 14 when the squeegee tool 33 is assembled with the containment unit 10' (as depicted in FIGS. 12B and 12C; FIG. 12A shows the components in registry prior to assembly). The structure of the containment unit 10' along the lateral walls 17' is also configured so as to best accommodate the modified form of the squeegee tool head and, in particular, the tab-like lateral tabs 43 and elements 47.

FIG. 11 shows the containment unit 10' utilized with a separate brush B for the removal of solid, particulate debris. A vacuum hose 46 is connected to the coupling collar 26, formed on the lateral wall 17' and surrounding the hole 49, which is visible in this figure and in FIG. 9.

The systems of FIGS. 13 through 22 are modified significantly from those of the foregoing figures but nevertheless function to contain matter, cleared from a surface, in a closed and effectively sealed chamber. Rather than utilizing a squeegee tool to close the chamber entrance, as in the embodiments previously described, the present systems comprise closure members that are integrated into the containment units.

More particularly, in the embodiment of FIG. 13 through 16 the containment unit, generally designated by the numeral 50, includes a containment body 52 having a circular forward portion comprised of an upper arcuate wall section 55 and a lower arcuate wall section 57 (best seen in FIG. 16), which define a slot-like opening 54 spanning the front of the containment body 52. A ramp 16' intersects with the lower arcuate wall section 57 and leads to the internal chamber 59 of the containment body 52. A curved flange 53 extends across the rear of the containment body 52, and defines an upwardly opening trough 61.

The containment unit 50 incorporates a revolving door structure, generally designated by the numeral 56, which includes a closure section 58, formed as a cylindrical section, having sectorial flange elements 60 at its opposite ends (only one of which is visible in FIG. 16). Each flange element 60 is fixedly attached to a hub member 62, which members 62 are in turn rotatably mounted in the lateral wall elements 63 that cooperatively define the containment body 52.

The unit 50 also includes a U-shaped handle, generally designated by the numeral 64, comprised of a cross-piece 65, having structure defining a central notch 66 thereon, and arms 67 at its opposite ends. The outer ends of the arms 67 are attached to the hub members 62, and thus enable rotation of the door structure 56 by pivoting of the handle 64 (as indicated by the opposing arrows in FIG. 16).

In FIG. 16, the closed position of the closure section 58 of the door structure 56 is depicted in full line (as is also shown in FIG. 14), and the open position is depicted in broken line (and is also shown in FIG. 13). As will be noted, the handle 64 is in an elevated (normally vertical) position for closing the door structure 56 and is in a rearwardly lowered positioned (normally horizontal) for moving the closure section 56 to its open position.

As seen in FIGS. 13, 15A and 15B, a squeegee tool, generally designated by the numeral 33' consists of a tapered handle 38 attached to the shoulder plate 40' of a head structure, which includes a blade element 34 attached to extend across the lower end of a forward flange portion 45'. Needless to say, the squeegee tool 33' is utilized to remove the semi-liquid matter from a surface, onto and up the ramp 16' and into the chamber 59 of the containment body 52. The handle 64 can thereupon be elevated to enable transport of the contents, for disposal, without concern for escape or leakage from the chamber 59. In the stored position, depicted in FIGS. 15A and 15B, a portion of the handle 38 of the squeegee tool 33' adjacent the shoulder plate 40' is received and engaged in the central notch 66 of the containment unit handle 64, with the blade 34 and lower portion of the forward flange 45' seated in the trough 61 defined by the curved flange 53.

The system shown in FIGS. 17-20 is substantially the same as that of FIGS. 13-16, with the exception of the effects of the operating handle position. As seen in FIGS. 19 and 20, the handle 64 is rotated to its forwardmost (normally horizontal) position to cause the closure section 58 to block the opening 54; as seen in FIGS. 16 and 18 (and indicated in FIG. 20), the closure section 58 is displaced away from the opening 54 when the handle 64 is either vertical or in its rearwardly directed horizontal position.

FIG. 18 shows use of the containment unit 50 for effecting the removal of debris using a brush B. Ultimate removal is assisted by evacuation of the chamber 59; the vacuum machine hose 46 is attached to the unit 50 as hereinabove described.

The system depicted in FIGS. 21-24 is also similar to the embodiments of FIGS. 13-20, with the exception that the squeegee tool, generally designated by the numeral 70, is adapted for use not only with the containment unit 50' but also by direct connection to any suitable vacuum system through its hose 46. Thus, as is best seen in FIG. 24, the handle of the squeegee tool 70 consists of a hollow tapered section 72 having a bore 73, a cylindrical collar section 74 at one end, and a suction head 76 at the opposite end. The head 76 is formed to define at least one fluid flow passage 78 in communication with the bore 73, and a pair of squeegee-like blade elements 80 are provided along an intake slot. When attached to a vacuum, the material to be removed is drawn into the passage 78 of the head 76, and through the bore 73 of the handle 72 and the vacuum hose 46. As will be appreciated, both the squeegee 70 and also the containment unit 50' can be used with or without an applied vacuum. A storage position for the cleanup system is depicted in FIGS. 24A and 24B.

FIGS. 25 through 28 illustrate another system embodying the invention, wherein a driving tool, generally designated by the numeral 82, is tethered to a containment unit, generally designated by the numeral 84, by a flexible band 86, which may take the form of a stretchable V-belt, typically about 18 to 24 inches long. The head 88 of the tool 82 is slotted to engage the upper edge of the flexible band 86, such that the engaged length of the band functions as a squeegee element. Moving the driving tool 82 towards the containment unit 84 (or vice versa), with the band 86 completing an enclosure of the matter to be removed (as depicted in FIGS. 25 and 26), effectively advances the matter up the ramp and into the chamber of the containment unit. Such movement also causes the band 86 to fold inwardly, in a closed relationship with the tool snapped neatly and in mated engagement with the containment unit (as depicted in FIGS. 27 and 28), effectively sealing the chamber entrance and enabling secure transport of the contained material to a desired location for disposal. A spring motor or like mechanism (not illustrated) can be used to draw the ends of the band 86 into the housing of the containment unit 84. As can be seen, a gasket element 43 partially surrounds the mouth of the containment unit chamber, and cooperates for the prevention of material leakage or escape.

The containment unit of the system depicted in FIGS. 29-33, generally designated by the numeral 50", is of generally similar construction to that which is illustrated in FIGS. 13-16. In this embodiment however the squeegee tool, generally designated by the numeral 90, consists of a generally rectangular frame-like handle 92 having a head portion 94 that extends along one of the longer sides of the rectangular and in which a blade element 96 is secured; grip-enhancing structure 97 is provided on the other of the longer sides of the rectangle.

The tool 90 is dimensioned and configured to conform to the outer portion of the U-shaped handle 64' on the containment unit 50", with sufficient clearance to permit free pivotal movement of the handle. A slot 98 is molded into the handle 64', and serve to frictionally engage ears 99 that project from the handle 92 of the squeegee tool 90, thus enabling ready assembly with the containment unit handle 64'. A trough 61' is formed along the back of the containment unit 50" and receives the head portion 94 and blade element 96 of the tool 90 when the handle 64' is positioned in the orientation shown in FIG. 29. FIGS. 30 and 31 show the system with the handle 64' oriented partially and fully forwardly, respectively; FIG. 32 shows the system in use with the handle 64' in an upright, normally vertical orientation; FIG. 33 shows a stored position of the system.

The embodiment of FIGS. 34-37 consists of a containment unit, generally designated by the numeral 100, comprised of a containment section 102, which is of generally semi-elliptical form, and a handle 104 that projects from one edge of the containment section. A resilient, quick recoil loop or band 106, operatively connected to a trigger 108 disposed within the handle 104, extends from the opposite side of the containment 102; the loop 106 may desirably be of PVC fabrication. As seen in FIG. 37, the system of this embodiment is utilized by surrounding the matter to be removed with the resilient band 106. Upon operation of the trigger 108, at least one of the opposite ends of the band 106 is retracted into the containment section 102 (such as by actuation of a spring motor or the like with a single pull) of the trigger 108, or by a mechanical pumping or ratcheting action effected by multiple trigger pulls, so as to thereby draw the matter into the chamber 110 of the section 102; a blade or lip 12 is provided at the entrance to the chamber so as to facilitate movement of material thereinto.

In the embodiment of the invention illustrated in FIGS. 38 through 40, the containment unit, generally designated by the numeral 114, is of box-like construction and includes a tubular guide sleeve 116 pivotably attached centrally at the top. A hold-down step plate 118 projects laterally from one side, and a blade or lip element 122 extends along the front of the unit 114 for facilitating the entry of matter into the chamber 120; engagement detents 123 (one of which is visible in FIG. 39) are formed into the opposite lateral walls of the containment unit 114, adjacent the chamber mouth.

The squeegee tool component, generally designated by the numeral 124, of which the system is comprised includes an elongate head 126 having an attached blade element 128, with rearwardly directed tab formations 130 at its opposite ends. The tabs 130 are formed with projecting bosses (not visible), which extend inwardly for cooperative engagement with the detents 123. A tubular stem or handle 132 extends from a central location of the squeegee tool head 126, and is slidably received within the tubular guide sleeve 116 on the containment unit 114.

As will appreciated, in use of the system of this embodiment the stem 132 of the squeegee tool 124 is first slid forwardly, within the guide sleeve 116, so as to position the head 126 in a spaced relationship to the containment unit 114 (as depicted in FIGS. 39 and 40). With the matter to be removed located between the head 126 and the unit 114, the stem 132 is pulled rearwardly so as to draw the matter into the chamber 120. In the fully retracted position, depicted in FIG. 38, the blade element 128 of the squeegee tool 124 closes the opening into the chamber 120, again to maintain the matter therewithin against leakage or escape. In the fully closed condition illustrated, the engagement bosses on the tab formations 130 seat in the delents 123 to cooperate in maintaining the head against inadvertent displacement. The pivotable handle 116 allows the user to apply variable pressure against the floor while pulling in a spill, or other deposited matter.

The embodiment of the invention illustrated in FIGS. 41 through 43 consists of a containment unit, generally designated by the numeral 140, in the form of a bag-like structure (e.g., a "polybag") having a lip or blade element 142 extending across its forward, lower edge at the mouth of the internal chamber (not visible), which is normally closed by a freely pivoting door or dam 144. A frame 146, having a flattened, generally triangular configuration, surrounds the open end of the bag 140 and is attached thereto for maintaining the open configuration. A normally upstanding handle 148 is disposed centrally on the frame 146.

A squeegee tool, generally designated by the numeral 150, consists of a transverse head 152 which supports a blade element 154 that extends along its length. A closure web 156 is attached to the head 152 on the side opposite to the blade element 154, and is shaped to conform (in cooperation with the head 152 and associated elements) to the space defined within the triangular frame 146 of the containment unit 140. A handle 158 is attached, by a connecting bar 160, to the head 152 of the squeegee tool, and its carries a snap-action friction clamp 162 that projects from an inner surface. A pair of rigid guide strips 164, pivotably connected to the squeegee head 152, extend from the opposite ends of the head and are slidably received within the containment unit 140.

As depicted in FIGS. 41 and 42, the system is in condition for use with the head 152 of the squeegee tool 150 spaced away from the bag 140 and with (in particular reference to FIG. 42) the matter to be removed surrounded by the bag 140, the squeegee tool head 152, and the guide strips 164. Sliding the squeegee tool 150 to the closed position illustrated in FIG. 43 (guided by the strips 164) effects displacement of the dam 144 and movement of the matter into containment unit bag 140, and it causes the web 156 and head elements to effectively seal the opening to the chamber 144.

Turning now in detail to FIGS. 44 and 45 of the drawings, therein illustrated is a modified form of the system depicted in FIG. 1 through 12, in which the containment unit, generally designated by the numeral 200, is of "clamshell" form and is adapted for use with an assembled, disposable bag-like insert, generally designated by the numeral 214.

The containment unit 200 consists of a rigid body 12' and a lid 15', which is pivotably connected to the body 12' by hinges 210. The lid 15' is normally closed, to mate with the body 12' and to function as a top wall for cooperatively defining the interior chamber 14' of the containment unit 200; the lid 15' can readily be pivoted upwardly to provide easy access to the interior chamber 14'. A flat post element 212, having a retaining lip 213 at its upper end, extends upwardly (in the normal orientation of the containment unit) from the bottom wall structure 13' and serves to retain the insert 214 in assembly within the body 12'.

The insert 214 will normally be fabricated from a polymeric material (e.g., a vinyl polymer, polyethylene, or polypropylene), and consists of a main body portion 216 having a reinforced front mouth opening 218 and a fin seal 220 across the back; the reinforcing element 219 is best seen in FIG. 45, engaged over the edge of the lid 15'. The seal 220 is formed with a centrally located slot or loop 222, which is dimensioned and configured to receive, and engage, the upstanding post 212. Sheath-like structure 224 is formed at the lower front of the body 216, and provides a pocket in which the ramp portion 217, which extends forwardly from the body 12', is received. FIG. 45 shows the insert 214 hooked in assembly with, and contained within, unit 200.

As is shown in FIG. 44, the clearing tool, generally designated by the numeral 30' is also modified from that of the previous figures, essentially by the incorporation of a disposable squeegee cover or attachment, generally designated by the numeral 224 and consisting of a collar section 226 and a blade element 227. Assembly is effected simply by inserting the existing squeegee blade element 34', and adjacent head structure, of the tool 30', through the collar 226 of the cover 224. Needless to say, use of the cover 224 renders the system entirely reusable, despite having been employed for obnoxious or toxic matter.

The system depicted in FIGS. 46 and 47 is similar that shown in FIGS. 41 through 43, with the exception that the bag-like structure 140' is disengageably assembled within the opening 147 of the frame 146. The structure 140' is formed with reinforcement 141 surrounding its mouth, and its leading edge may be provided by a rigid lip or blade element 142', functioning as a ramp and having integral pull tabs. Here again, the system provides economic and convenience benefits by permitting ready removal of the bag-like structure 140', for disposal.

Turning now to FIGS. 48 through 59 of the drawings, the embodiments therein illustrated consists of front structure, generally designated by the numeral 230 and taking the form of a planar panel; the front structure will normally fabricated from chipboard, paperboard, or other inexpensive rigid or semirigid material, but a wide variety of different forms may be substituted, and any suitable material may be employed for fabrication. A relatively large rectangular aperture 232 is formed through a lower portion of the panel 230, and a smaller aperture 234 is formed upwardly adjacent to it. A bag-like receptacle, generally designated by the numeral 236 and having a mouth 237 at one end, is attached (by fusion or adhesive bonding, or by other suitable means) in the marginal area surrounding the mouth 237 to the back side of the panel 230, with the mouth disposed to completely surround the rectangular aperture 232.

FIG. 52 shows a modification in which the receptacle 236 contains an insert 275, desirably in the form of a double-wall bag, filled with a highly absorbent material or medium 276. The walls of the insert 275 are porous or perforated, for the ready admission of liquid matter to be taken up by the absorbent material 276, and ultimately disposed of with the receptacle 236. As depicted, the insert and absorbent material are filled with liquid matter, and thus are enlarged and swollen from a relative flat state in which they may be provided. The construction of the insert 275 may be similar to that of commonly available disposable diaper products.

The clearing tool depicted consists of a head member and a tubular handle, generally designated by the numerals 238 and 240, respectively. The head member 238 will advantageously be fabricated as a thin, vacuum-formed plastic piece, configured to have a main panel portion 242, a surrounding flange 244, and a central, upstanding boss 248 having slot 250 extending transversely (diametrically) from top to the bottom thereacross; an integral squeegee element 246 extends from the flange 244 along the bottom edge of the head member 238.

As is best seen in FIGS. 55, 57, and 58, the head member is formed with an upstanding (continuous or discontinuous) ridge 252 behind the flange 244, which extends along at least its top edge, and preferably along its lateral edges as well. In assembly (the act of which is depicted in FIGS. 54 and 55), the corresponding marginal portions of the front panel structure 230 surrounding the aperture 232 engage, in a snap-fit relationship, between the ridge 252 and the corresponding portions of the flange 244, with the integral squeegee element 246 engaged behind the lower margin of the aperture 232. The head member 238 is thereby held securely, but disengageably, in assembly with the panel 230.

As can also be seen in these figures, the tubular handle 240 of the clearing tool, which may desirably be of injection-molded plastic construction, is removable from the head 238 member, thereby enabling its repeated use. The end section of the handle 240, between the terminal knob 254 and the spaced collar 256, is constructed for snap-fit interengagement within the slot 250 of the head member boss 248, to permit ready assembly and disassembly.

As shown in FIG. 50, the clearing tool 238, 240 is of course employed to clear away the unwanted matter, with the integral squeegee element 246 of the head member 238 wiping the soiled or contaminated surface. The bottom marginal portion of the front panel 230 provides an integral ramp section for guiding the matter into the aperture 232 and through the mouth 237 of the receptacle 236. After disengagement of the handle 240, the entire remaining assembly, containing the cleared matter, may be taken for disposal, as depicted in FIG. 53. It will be appreciated that an inexpensive handle (such as may be made from tubular cardboard or a cheap plastic extrusion) may be permanently (or disengageably) attached to the head member, to make complete disposal of the clearing practical from an economic standpoint.

A more positive engagement of the handle and head member may however be provided by the incorporation of a mechanical engaging or locking feature, one suitable form of which is incorporated into the handle, generally designated by the numeral 240', as illustrated in FIG. 57 through 59. Rather than having a fixed knob at its bottom end, the handle 240' employs a bolt, generally designated by the numeral 258, which is slideably mounted within the bore 260 of the handle 240' and is comprised of a knob formation 262 at one end of a rod-like part 263, which protrudes from the handle bore 260, and a pin or button 264 which extends laterally from the part 263 through a slot 266; the bolt 258 is biased upwardly (into its engagement position) by an internal coil spring 268.

The engaged relationship of the bolt 258 with the boss 248' of the head member 238' is shown in FIG. 57, and the disengaged relationship is shown in FIGS. 58 and 59. As is evident, disengagement is achieved by applying downward force to the protruding button 264 so as to displace the knob formation 266 from the boss 248'. As can be seen in FIG. 58, the boss 248' is indented (circumferentially) at 270 for more positive receipt of the knob formation 266 and the spaced collar 256 and to increase the security of mechanical connection.

Finally, a further modification to the system of FIGS. 48 through 59 is shown in FIG. 60. As can be seen, the bottom and lateral marginal portions 272, 274 of the front structure, generally designated by the numeral 230', are angled inwardly toward the plane of the central section 276. This configuration serves to funnel material into the receptacle bag during cleanup.

As will be appreciated by those of ordinary skill in the art, many modifications may be made to the cleanup system of the present invention without departure from the scope of the appended claims. The particular form, shape, and construction of the containment unit and clearing component, and of the parts thereof, may vary widely from those that are illustrated and specifically described herein, and suitable materials of construction, other than those mentioned, will be evident, all based upon the present disclosure; interengagement, assembly, and interconnection of components, elements, and parts may also be effected by any suitable means.

It should be emphasized that references herein to "closing" and "closure of" the entrance or access opening to a containment unit or receptacle (and use of forms of that terminology) mean that the cooperating parts, components, and elements mate sufficiently with one another (directly, or with an interposed gasket or the like) so as to leave no significant spaces or gaps through which a substantial amount of the contained matter can leak or escape, and that the tightness of the optimal fit will depend upon the nature of the matter, being solid, semi-liquid or liquid, toxic or benign, etc. The ultimate level of closure will produce a sealed, liquid-tight relationship.

Thus, it can be seen that the present invention provides a novel cleanup system with which liquid, semi-liquid, and/or dry matter can be moved from a surface into a receptacle and readily maintained therein without escape, undue leakage, or spillage. In certain embodiments, a material clearing component (e.g., a squeegee and/or brush tool) is engageable with a cooperating receptacle component for closing the access opening through which the removed matter passes into a chamber of the receptacle. The assembled clearing component or, more particularly, usually a head member of a clearing tool, serves to prevent such escape, leakage, or spillage; indeed, in some instances the clearing component serves to at least substantially seal the containment unit opening, which may be particularly important for industrial use or in other applications involving toxic or particularly obnoxious liquids. Alternatively, a receptacle, provided in accordance herewith, may have self-contained means for closing an access opening. The system of the invention may, as an economically practical matter, be partially or entirely disposable, thus affording increased convenience and avoiding a need for cleaning of a containment unit after use, and any receptacle or containment unit disclosed herein may contain an absorbent material, normally as an insert, for the improved containment and handling of liquid matter. The system will generally be of relatively incomplex and inexpensive construction, easy and convenient to use and store, and highly effective for its intended purposes.

Having thus described the invention, what is claimed is:

1. A cleanup system comprised of a containment unit and a separate clearing component; said containment unit comprising a rigid body defining a chamber for containing matter, and having structure defining a top opening into said chamber and a contiguous front entrance to said chamber, permitting, unless closed, the substantial escape of matter from said chamber; said clearing component being a tool having a head member comprised of closure structure including at least one marginal portion having a surface-clearing element in the form of a squeegee element thereon, and a plate portion extending from said marginal portion; at least one of said containment unit and said clearing component having means thereon for securing said containment unit and said clearing component in an interengaged relationship in which said closure structure of said clearing component overlies said top opening and said front entrance of said containment unit, said closure structure being dimensioned and configured to close said top opening and said entrance, in said overlying position, against the substantial escape of matter therethrough from said chamber; said squeegee element of said head member of said tool being disposed upon entrance-defining structure of said containment unit in said interengaged relationships, to cooperate in effecting closure of said entrance to said chamber; and at least one of said opening- and entrance-defining structure of said containment unit, and said head member of said clearing component, including a gasket element disposed to bear upon the other of said opening- and entrance-defining structure and said head member, said gasket element cooperating with said squeegee element so as to provide a substantially liquid-tight seal thereat, in said overlying position.

2. The cleanup system of claim 1 wherein said opening- and entrance-defining structure of said containment unit, and said head member of said clearing component, have edge sections that mate with one another for cooperatively closing said opening and said entrance in said overlying position.

3. The cleanup system of claim 2 wherein said at least one marginal portion of said closure structure of said clearing component lies substantially in a first plane of said head member, and wherein said plate portion thereof lies substantially in a second plane, generally perpendicular to said first plane, and provides a said mating edge section thereon.

4. The cleanup system of claim 1 wherein said entrance-defining structure of said containment unit includes, along a bottom edge, an internal wall portion, and wherein, in said interengaged relationship, a said surface-clearing element of said head member of said tool is disposed against said internal wall portion.

5. A cleanup system comprised of a containment unit and a separate clearing component; said containment unit comprising a rigid body defining a chamber for containing matter, and having structure defining a top opening into said chamber and a contiguous front entrance to said chamber, permitting, unless closed, the substantial escape of matter from said chamber; said clearing component being a tool having a head member comprised of closure structure including at least one marginal portion having a surface-clearing element thereon, and a plate portion extending from said marginal portion; at least one of said containment unit and said clearing component having means thereon for securing said containment unit and said clearing component in an interengaged relationship in which said closure structure of said clearing component overlies said top opening and said front entrance of said containment unit, said closure structure being dimensioned and configured to close said top opening and said entrance, in said overlying position, against the substantial escape of matter therethrough from said chamber; and said head member of said tool having substantially parallel marginal portions extending thereacross, each of said marginal portions having a said surface-clearing element thereon, one of said surface-clearing elements being a squeegee element and the other of said surface-clearing elements being a brush element.

6. The cleanup system of claim 5 wherein said body of said containment unit has a rearwardly extending handle thereon and wherein said tool has a handle extending from said head member, said handles on said body and tool being constructed for interengagement to provide said means for securing said containment unit and said clearing component in interengaged relationship.

7. The cleanup system of claim 5 wherein said, entrance-defining structure includes a ramp portion leading to said entrance to said chamber.

8. The cleanup system of claim 5 wherein said body of said containment unit includes structure defining a port for clean-out, material discharge, or both; and wherein said system additionally includes a removable cap attached to said port-defining structure to normally close said port.

9. The cleanup system of claim 5 further including a disposable, bag-like insert, for receiving matter, contained within said chamber of said containment unit body and having a normally open mouth disposed to cooperate with said opening- and entrance-defining structure for the receipt of matter displaced into said containment unit.

10. The cleanup system of claim 9 wherein said containment unit body includes a top wall portion that is displaceable to facilitate insertion and removal of said bag-like insert into and from said chamber.

11. The cleanup system of claim 5 wherein said substantially parallel marginal portions of said head member of said tool are opposite to one another.

* * * * *